US010690014B2

(12) United States Patent
Jang et al.

(10) Patent No.: US 10,690,014 B2
(45) Date of Patent: Jun. 23, 2020

(54) COOLING MODULE, SUPERCRITICAL FLUID POWER GENERATION SYSTEM INCLUDING THE SAME, AND SUPERCRITICAL FLUID SUPPLY METHOD USING THE SAME

(71) Applicant: DOOSAN HEAVY INDUSTRIES & CONSTRUCTION CO., LTD., Changwon-si, Gyeongsangnam-do (KR)

(72) Inventors: Juntae Jang, Seoul (KR); Sanghyeun Kim, Yongin-si (KR); Hwachang Sung, Seoul (KR); Gonjoo Lee, Seongnam-si (KR); Songhun Cha, Osan-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 20 days.

(21) Appl. No.: 15/945,748

(22) Filed: Apr. 5, 2018

(65) Prior Publication Data

US 2018/0328237 A1 Nov. 15, 2018

(30) Foreign Application Priority Data

May 12, 2017 (KR) ..... 10-2017-0059256
Jun. 15, 2017 (KR) ..... 10-2017-0075808

(51) Int. Cl.
*F01K 25/10* (2006.01)
*F01K 9/00* (2006.01)
(Continued)

(52) U.S. Cl.
CPC ..... *F01K 25/103* (2013.01); *F01K 9/003* (2013.01); *F28B 1/02* (2013.01); *F28B 9/04* (2013.01)

(58) Field of Classification Search
CPC ..... F01K 9/003; F01K 25/10; F01K 25/103; F28D 2021/0063; F28D 3/02; F28B 1/02;
(Continued)

(56) References Cited

U.S. PATENT DOCUMENTS 2,982,864 A * 5/1961 Furreboe ..... F01K 7/40 290/2
5,423,377 A * 6/1995 Iwata ..... F01K 9/00 165/110
(Continued)

FOREIGN PATENT DOCUMENTS

JP H05-019744 U 3/1993
JP 2004-339965 A 12/2004
(Continued)

OTHER PUBLICATIONS

A Korean Office Action dated Sep. 26, 2018 in connection with Korean Patent Application No. 10-2017-0075808 which corresponds to the above-referenced U.S. application.
(Continued)

*Primary Examiner* — Mark A Laurenzi
*Assistant Examiner* — Xiaoting Hu
(74) *Attorney, Agent, or Firm* — Invenstone Patent, LLC

(57) ABSTRACT

A cooling module is included in a supercritical fluid power generation system and is used in supercritical fluid supply method. The cooling module includes a cooling source flow unit in which a cooling source supplied from an outside flows, a cooler unit, and a buffer unit. The cooler unit enables a gas-phase working fluid introduced through a working fluid inlet port to undergo a phase change into a liquid-phase working fluid by performing heat exchange with the cooling source flowing in the cooling source flow unit. The buffer unit is provided under the cooler unit and receives and stores the liquid-phase working fluid cooled by
(Continued)

the cooler unit. The stored liquid-phase working fluid is supplied to an outside fluid pump. Consequently, stable supply of the working fluid is achieved by the supercritical fluid power generation system.

16 Claims, 31 Drawing Sheets

(51) Int. Cl.
*F28B 1/02* (2006.01)
*F28B 9/04* (2006.01)

(58) Field of Classification Search
CPC ..... F28B 9/02; F28B 9/04; F28B 9/08; F28B 9/06; F28F 9/0246; F28F 9/0256; F28F 2210/02; F28F 2250/104; F28F 2210/04; F28F 2210/10
See application file for complete search history.

(56) References Cited

U.S. PATENT DOCUMENTS

| | | | | |
|---|---|---|---|---|
| 2002/0029572 | A1* | 3/2002 | Kangai | F28B 11/00 60/685 |
| 2012/0216762 | A1* | 8/2012 | Ernst | F01N 5/02 123/41.21 |
| 2013/0000867 | A1* | 1/2013 | Szabo | F01K 9/003 165/96 |
| 2014/0166252 | A1* | 6/2014 | Cur | F28D 3/02 165/157 |
| 2017/0051981 | A1* | 2/2017 | Singh | F01K 9/003 165/96 |

FOREIGN PATENT DOCUMENTS

| | | | | |
|---|---|---|---|---|
| JP | 2005-106039 | A | | 4/2005 |
| JP | 2012-508842 | A | | 4/2012 |
| JP | 2012145092 | A | | 8/2012 |
| JP | 2016164377 | A | * | 9/2016 |
| KR | 10-2012-0128753 | A | | 11/2012 |
| KR | 101280519 | B1 | * | 7/2013 |
| KR | 10-1553196 | B1 | | 9/2015 |
| KR | 101623309 | B1 | | 5/2016 |
| KR | 20160069659 | A | | 6/2016 |

OTHER PUBLICATIONS

A Korean Office Action dated Dec. 19, 2017 in connection with Korean Patent Application No. 10-2017-0059256 which corresponds to the above-referenced U.S. application.

* cited by examiner

COOLING MODULE, SUPERCRITICAL FLUID POWER GENERATION SYSTEM INCLUDING THE SAME, AND SUPERCRITICAL FLUID SUPPLY METHOD USING THE SAME

CROSS-REFERENCE TO RELATED APPLICATIONS

This application claims priority to and the benefit of Korean Patent Applications No. 10-2017-0059256 and No. 10-2017-0075808 filed in the Korean Intellectual Property Office on May 12, 2017 and Jun. 15, 2017, respectively, the entire contents of which are incorporated herein by reference.

BACKGROUND OF THE INVENTION

Field of the Invention

The present invention relates to a cooling module, a supercritical fluid power generation system including the same, and a supercritical fluid supply method using the same.

Description of the Related Art

Internationally, there is a growing need for efficient electric power production, and the movement to reduce the generation of pollutants is becoming more and more active. Thus, various efforts are being made to increase the production of electric power while reducing the generation of pollutants. One such effort is the research and development toward a supercritical carbon dioxide ($CO_2$) power generation system that uses supercritical carbon dioxide as a working fluid, as disclosed in Japanese Patent Laid-Open Publication No. 2012-145092.

Supercritical carbon dioxide has a density similar to that of a liquid and a viscosity similar to that of a gas, thus making it possible to reduce the size of an apparatus using the same and to minimize the power consumption required for the compression and circulation of a fluid. Moreover, supercritical carbon dioxide is easy to handle because it has critical points of 31.4° C. and 72.8 atm, which are much lower than the critical points of 373.95° C. and 217.7 atm of water. A power generation system using such supercritical carbon dioxide shows a net power generation efficiency of about 45% when operating at 550° C. Moreover, the power generation system may improve power generation efficiency by 20% or more, compared with the power generation efficiency of a conventional steam cycle, and may reduce the size of a turbo device to one tenth of the original.

SUMMARY OF THE INVENTION

Therefore, the present invention has been made in view of the related art, and it is an object of the present invention to provide a cooling module that is capable of stably supplying a working fluid, a supercritical fluid power generation system including the same, and a supercritical fluid supply method using the same.

In accordance with an aspect of the present invention, the above and other objects can be accomplished by the provision of a cooling module including a cooling source flow unit in which a cooling source supplied from an outside flows; a cooler unit configured to enable a gas-phase working fluid introduced through a working fluid inlet port to undergo a phase change into a liquid-phase working fluid by performing heat exchange with the cooling source flowing in the cooling source flow unit; and a buffer unit provided under the cooler unit and configured to receive and store the liquid-phase working fluid cooled by the cooler unit and to supply the stored liquid-phase working fluid to the outside.

The buffer unit may include an upper part disposed below a lower part of the cooler unit, and the lower part of the cooler unit communicates with the upper part of the buffer unit to receive and the liquid-phase working fluid cooled by the cooler unit.

The cooling module may further include a transport pipe for transporting the liquid-phase working fluid that has been cooled by the cooler unit to the buffer unit, and the buffer unit may be located so as to be spaced apart from the cooler unit. In other words, the cooler unit and the buffer unit may be separately formed and configured so as to be spaced apart from each other.

The cooling module may further include a housing including a cooler unit housing of the cooler unit and a buffer unit housing of the buffer unit, and the cooler unit and the buffer unit may be integrally formed to constitute the housing. The housing may be configured to extend downward. The working fluid inlet port may be formed in one side of the housing. The cooling source in the cooling source flow unit may flow upward from a lower part of the one side of the housing. The gas-phase working fluid introduced through the working fluid inlet port may perform heat exchange with the cooling source while flowing downward, whereby the gas-phase working fluid undergoes a phase change into a liquid-phase working fluid.

The cooling module may further include an opening and closing unit provided to a lower side of the cooler unit housing to selectively open and close the buffer unit, to prevent evaporation of the stored liquid-phase working fluid by a gas-phase working fluid that is not yet in a cooled state.

The cooling source flow unit may be configured to pass sequentially through the buffer unit and the cooler unit, and the cooling source may perform heat exchange with the working fluid stored in the buffer unit and may then perform heat exchange with the working fluid introduced into the cooler unit.

The cooling source flow unit may include a cooler-side flow unit extending via the cooler unit and a buffer-side flow unit extending via the buffer unit. Thus, a cooling source flowing in the cooler-side flow unit may perform heat exchange with the working fluid introduced into the cooler unit, and a cooling source flowing in the buffer-side flow unit may perform heat exchange with the working fluid stored in the buffer unit. The cooler-side flow unit and the buffer-side flow unit may be connected to each other outside the cooler unit.

The cooling source flow unit may branch into the cooler-side flow unit and the buffer-side flow unit. The cooling source flowing in the buffer-side flow unit may first performs heat exchange with the working fluid stored in the buffer unit and may then join the cooling source flowing in the cooler-side flow unit.

The cooling source flow unit may be configured such that the cooling source is introduced through one side of the cooler unit and is discharged through the one side of the cooler unit. That is, the cooling source flow unit may have a U-shaped configuration including an upper flow unit and a lower flow unit. The cooling source that flows in the upper flow unit may first perform heat exchange with the working fluid introduced through the working fluid inlet port, and the cooling source that flows in the lower flow unit may then perform heat exchange with the working fluid that has performed heat exchange with the cooling source in the upper flow unit.

The buffer unit may receive a liquid-phase working fluid from the outside. That is, the cooling module may further include an auxiliary supply unit for replenishing the buffer unit with a liquid-phase working fluid when a level of the working fluid in the buffer unit drops below a predetermined level.

The cooling module may further include an auxiliary cooler unit having a refrigerant flow path, a portion of which is located in at least one of the buffer unit and the cooler unit.

The buffer unit preferably has an aspect ratio greater than 1.

In accordance with another aspect of the present invention, there is provided a supercritical fluid power generation system including the above cooling module and a fluid pump for receiving and pumping the liquid-phase working fluid stored in the buffer unit of the cooling module.

In accordance with a further aspect of the present invention, there is provided a supercritical fluid supply method including steps of cooling a gas-phase working fluid into a liquid-phase working fluid; storing the cooled liquid-phase working fluid in a buffer unit; transporting the liquid-phase working fluid stored in the buffer unit to a fluid pump; and pumping the liquid-phase working fluid through the fluid pump.

The method may further include a step of cooling a gas-phase working fluid contained in the working fluid stored in the buffer unit, which has not been cooled, into a liquid-phase working fluid through a refrigerant flow path, a portion of which is located in the buffer unit. Here, the cooled gas-phase working fluid may be stored the buffer unit.

The method may further include a step of replenishing the buffer unit with a liquid-phase working fluid when a level of the working fluid in the buffer unit drops below a predetermined level.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
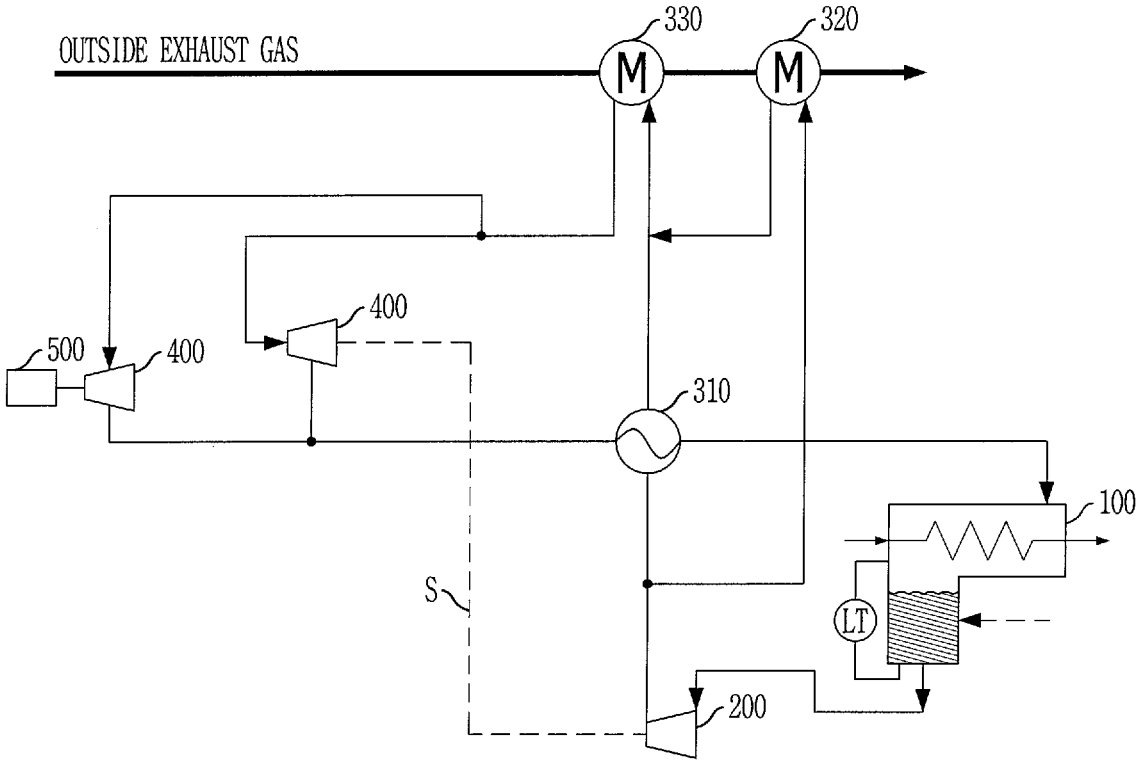
FIG. 1 is a diagram of a supercritical fluid power generation system according to an embodiment of the present invention.

Since embodiments of the present invention can be variously modified in many different forms, reference will now be made in detail to specific embodiments of the present invention. It is to be understood that the present description is not intended to limit the present invention to those specific embodiments and that the present invention is intended to cover not only the specific embodiments but also various alternatives, modifications, equivalents and other embodiments that may be included within the spirit and scope of the present invention as defined by the appended claims.

The terminology used herein is for the purpose of describing particular embodiments only and is not intended to be limiting. As used herein, the singular forms are intended to include the plural forms as well, unless the context clearly indicates otherwise. It will be further understood that the terms "comprise", "include", "have", etc. when used in this specification, specify the presence of stated features, integers, steps, operations, elements, components, and/or combinations thereof, but do not preclude the presence or addition of one or more other features, integers, steps, operations, elements, components, and/or combinations thereof.

Hereinafter, exemplary embodiments of the present invention will be described in detail with reference to the accompanying drawings. Here, wherever possible, the same reference numbers will be used throughout the drawings to refer to the same or like parts. In addition, in the following description of the embodiments, a detailed description of known functions and configurations incorporated herein will be omitted when it may impede the understanding of the embodiments. For the same reason, in the drawings, some components are exaggerated, omitted or schematically illustrated.

In general, a supercritical fluid power generation system forms a closed cycle that does not discharge a working fluid used for power generation to the outside, and uses, as the working fluid, supercritical carbon dioxide, supercritical nitrogen, supercritical argon, supercritical helium, or the like.

The supercritical fluid power generation system may use exhaust gas, which is discharged from a thermoelectric power plant or the like. The exhaust gas may be used not only in a single power generation system, but also in a hybrid power generation system comprising a gas turbine power generation system and a thermoelectric power generation system.

The working fluid in the cycle passes through a compressor, and is then heated while passing through a heat source such as a heater to thereby enter a high-temperature and high-pressure supercritical state, and the resulting supercritical working fluid drives a turbine. A generator is connected to the turbine and is driven by the turbine to produce electric power. The working fluid used for the production of electric power is cooled while passing through a heat exchanger, and the cooled working fluid is again supplied to the compressor to circulate in the cycle. A plurality of turbines or a plurality of heat exchangers may be provided.

The supercritical fluid power generation system according to any of various embodiments of the present invention conceptually includes not only a system in which the entirety of a working fluid flowing in the cycle is in a supercritical state, but also a system in which only the majority of the working fluid flows while in a supercritical state with the remainder being in a subcritical state.

FIG. 1 shows a supercritical fluid power generation system according to an embodiment of the present invention.

As shown in FIG. 1, the supercritical fluid power generation system according to the embodiment of the present invention includes a cooling module 100, a fluid pump 200, first to third heat exchangers 310, 320 and 330, at least one turbine 400, and a generator 500. The supercritical fluid power generation system according to the embodiment of the present invention uses, as the working fluid, for example, at least one of supercritical carbon dioxide, supercritical nitrogen, supercritical argon, supercritical helium, and the like. In the following description, carbon dioxide ($CO_2$) is used as the working fluid. However, the present invention is not limited thereto.

It should be understood that the respective components of the present invention are connected to one another by a transport pipe in which the working fluid flows and that the working fluid flows along the transport pipe, although this is not specifically mentioned. However, in the case in which a plurality of components is integrated, because a component or a region, which effectively serves as the transport pipe, may be present in the integrated configuration. Even in this case, it should be naturally understood that the working fluid flows along the transport pipe. A flow path having a separate function will be additionally described.

The turbine 400 is driven by the working fluid, and serves to produce electric power by driving the generator 500, which is connected to at least one turbine. Since the working fluid expands while passing through the turbine 400, the turbine 400 also serves as an expander.

A gas-phase working fluid is introduced into the cooling module 100. The introduced gas-phase working fluid is cooled and undergoes a phase change into a liquid-phase working fluid.

The fluid pump 200 receives the working fluid, which has undergone the phase change into the liquid-phase working fluid via cooling, and compresses the working fluid to make the working fluid enter a low-temperature and high-pressure state. The fluid pump 200 may be a rotary-type pump which is connected to the turbine 400 via a single drive shaft S, and upon rotation of the turbine 400, the fluid pump 200 is thus rotated together with the turbine 400.

Some of the working fluid, which has passed through the fluid pump 200, undergoes heat exchange with a medium-temperature and low-pressure working fluid in the first heat exchanger 310 to enter a medium-temperature and high-pressure state, and is heated by high-temperature outside exhaust gas in the third heat exchanger 330 to enter a high-temperature and high-pressure state.

The remaining working fluid, which has passed through the fluid pump 200, is heated by the high-temperature outside exhaust gas in the second heat exchanger 320 to enter a medium-temperature and high-pressure state, and is heated by the high-temperature outside exhaust gas in the third heat exchanger 330 to enter a high-temperature and high-pressure state.

The high-temperature and high-pressure working fluid enters a medium-temperature and low-pressure state while passing through the turbine 400. Then, while passing through the first heat exchanger 310, the working fluid undergoes heat exchange with some of the low-temperature and high-pressure working fluid, which has passed through the fluid pump 200, to enter a low-temperature and low-pressure state, and is then introduced into the cooling module 100.

In the embodiment of the present invention, the cooling module 100 is located between the first heat exchanger 310 and the fluid pump 200. The cooling module 100 changes a gas-phase working fluid into a liquid-phase working fluid, stores the phase-changed working fluid, and supplies the stored working fluid to the fluid pump 200. That is, the cooling module 100 serves as both a cooler and a buffer. The supercritical fluid power generation system is capable of stably supplying a liquid-phase working fluid to the fluid pump 200 through the cooling module 100. In addition, stable level control in a buffer unit 120 of the cooling module 100 is possible, since the change in the level of the working fluid in the cooling module depending on a change in the amount of liquid-phase working fluid is large.

Hereinafter, various examples of a cooling module 100 according to a first embodiment of the present invention will be described with reference to FIGS. 2 to 6.

As shown, the cooling module 100 according to the first embodiment of the present invention includes a cooler unit 110 and a buffer unit 120 disposed below the cooler unit 110. Each of the cooler unit 110 and the buffer unit 120 has a housing formed so as to have a predetermined shape. A cooler unit housing 111 and a buffer unit housing 121 may be integrally formed, may be separately formed and separately situated, or may be separately formed and then joined to each other. In any event, a lower part of the cooler unit housing 111 communicates with an upper part of the buffer unit housing 121.

The cooler unit 110 has a working fluid inlet port 112, formed in an upper side or upper part of the cooler unit housing 111 of the cooler unit 110, and a cooling source flow unit 113. An external gas-phase working fluid is introduced into the cooling module 100 through the working fluid inlet port 112. For example, a low-temperature and low-pressure gas-phase working fluid is introduced into the cooling module 100 through the working fluid inlet port 112 from the first heat exchanger 310.

The cooling source flow unit 113 is defined in the cooler unit housing 111. An external cooling source flows in the cooler unit 110 along the cooling source flow unit 113. The cooling source flow unit 113 is formed, for example, in the shape of a pipe surrounded by the gas-phase working fluid within the cooler unit 110. While flowing in the pipe, the cooling source, or coolant, absorbs heat from the gas-phase working fluid outside the pipe. That is, heat of the gas-phase working fluid is absorbed by the cooling source. As a result, the gas-phase working fluid undergoes a phase change into a liquid-phase working fluid. The cooling source may be liquid or gas having a lower temperature than the gas-phase working fluid. For example, the cooling source may be liquefied natural gas (LNG) or water.

Figure 2:
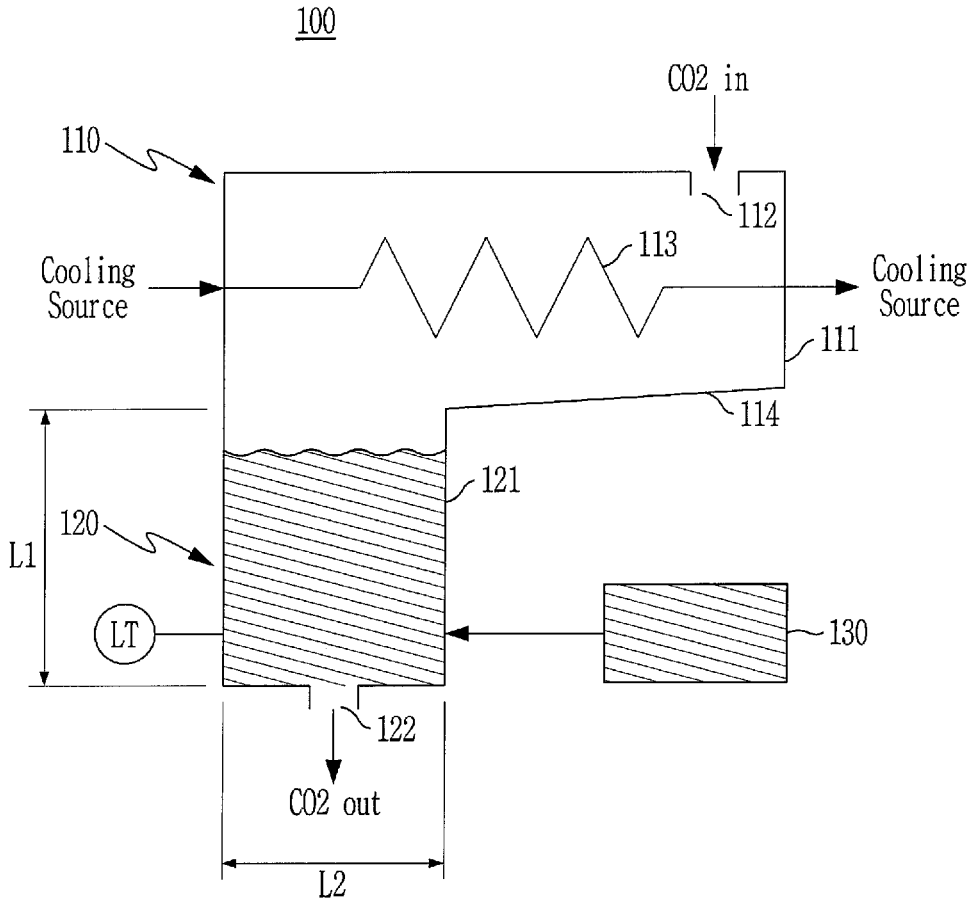
FIGS. 2 to 6 are diagrams showing various examples of a cooling module according to a first embodiment of the present invention.
Figure 3:
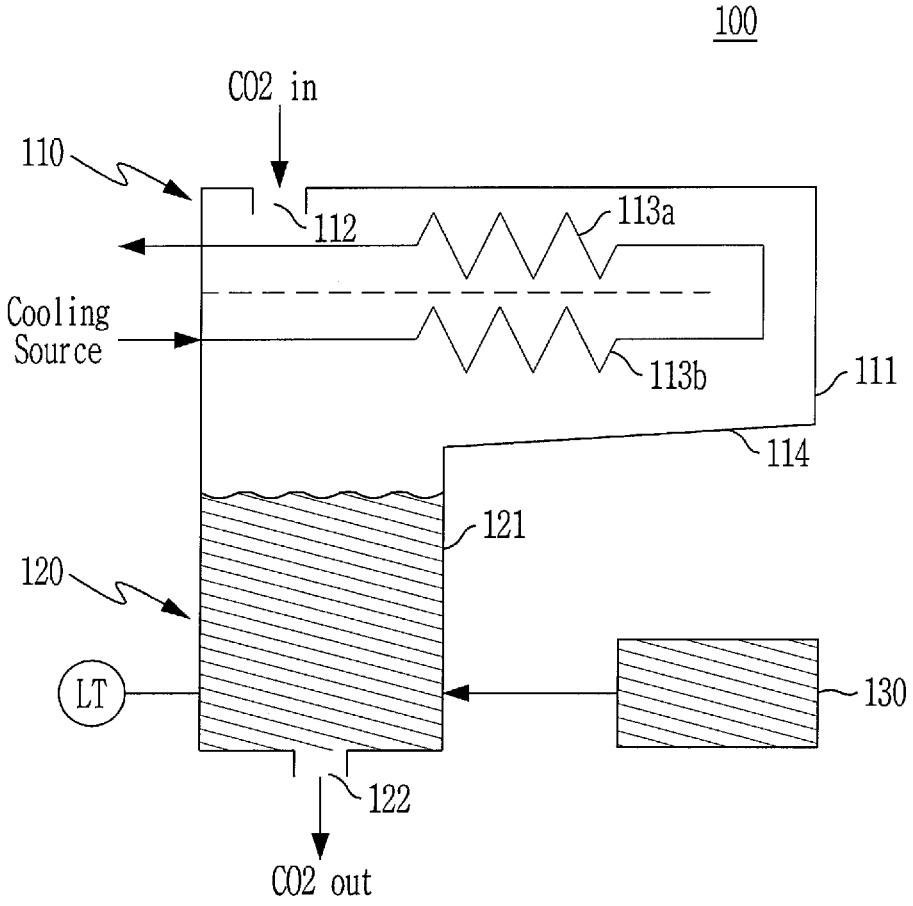

As shown in FIG. 2, the cooling source flow unit 113 may be configured to follow a straight line (path) through to cooler unit 110, by which the cooling source is introduced through one side of the cooler unit housing 111 and is discharged through the other side of the cooler unit housing 111. Alternatively, as shown in FIG. 3, the cooling source flow unit 113 may have a U-shaped configuration for entering and exiting the cooler unit 110, by which the cooling source is introduced through one side of the cooler unit housing 111 and is discharged through the same side of the cooler unit housing 111.

In either of the cooling module configurations shown in FIGS. 2 and 3, the buffer unit 120 is disposed under the cooler unit 110 so as to be positioned immediately below a first portion of the lower side of the cooler unit 110, and not below a second portion of the lower side of the cooler unit 110, which is provided with an inclined surface to be described later. In view of this disposition of the buffer unit 120, for a straight-line type cooling source flow unit 113, the working fluid inlet port 112 may be formed in cooler unit housing 111 to be positioned above the second portion. For a U-shaped type cooling source flow unit 113, the working fluid inlet port 112 may be formed in the cooler unit housing 111 to be positioned above the above the first portion.

The U-shaped type cooling source flow unit 113 may include an upper flow unit 113*a* and a lower flow unit 113*b*. The cooling source that flows in the upper flow unit 113*a* may first perform heat exchange with the working fluid that is introduced through the working fluid inlet port 112, and the cooling source that flows in the lower flow unit 113*b* may then perform heat exchange with the working fluid that has performed heat exchange with the cooling source in the upper flow unit 113*a*.

At this time, the cooling source may be introduced into the lower flow unit 113*b* and may then flow to the upper flow unit 113*a*. Since the cooling source undergoes heat exchange in the lower flow unit 113*b* and then undergoes heat exchange in the upper flow unit 113*a*, the temperature of the cooling source that flows in the upper flow unit 113*a* is higher than the temperature of the cooling source that flows in the lower flow unit 113*b*. The working fluid introduced through the working fluid inlet port 112 performs primary heat exchange with the cooling source that flows in the upper flow unit 113*a*, and then performs secondary heat exchange with the cooling source that flows in the lower flow unit 113*b*. The working fluid performs heat exchange with a relatively high-temperature cooling source, and then performs heat exchange with a relatively low-temperature cooling source. That is, primary heat exchange is performed between a high-temperature working fluid that has not undergone heat exchange and a high-temperature cooling source that has undergone heat exchange in the vicinity of the upper flow unit 113*a*, and secondary heat exchange is performed between a low-temperature working fluid that has undergone heat exchange and a low-temperature cooling source that has not undergone heat exchange in the vicinity of the lower flow unit 113*b*, whereby heat exchange efficiency may be improved.

The portion of the lower side of the cooler unit housing 111 that is not connected to the buffer unit housing 121, i.e., the above-mentioned second portion, may be provided with an inclined surface 114, along which the working fluid that has undergone the phase change into the liquid-phase working fluid slides and is then introduced into the buffer unit 120.

Figure 4:
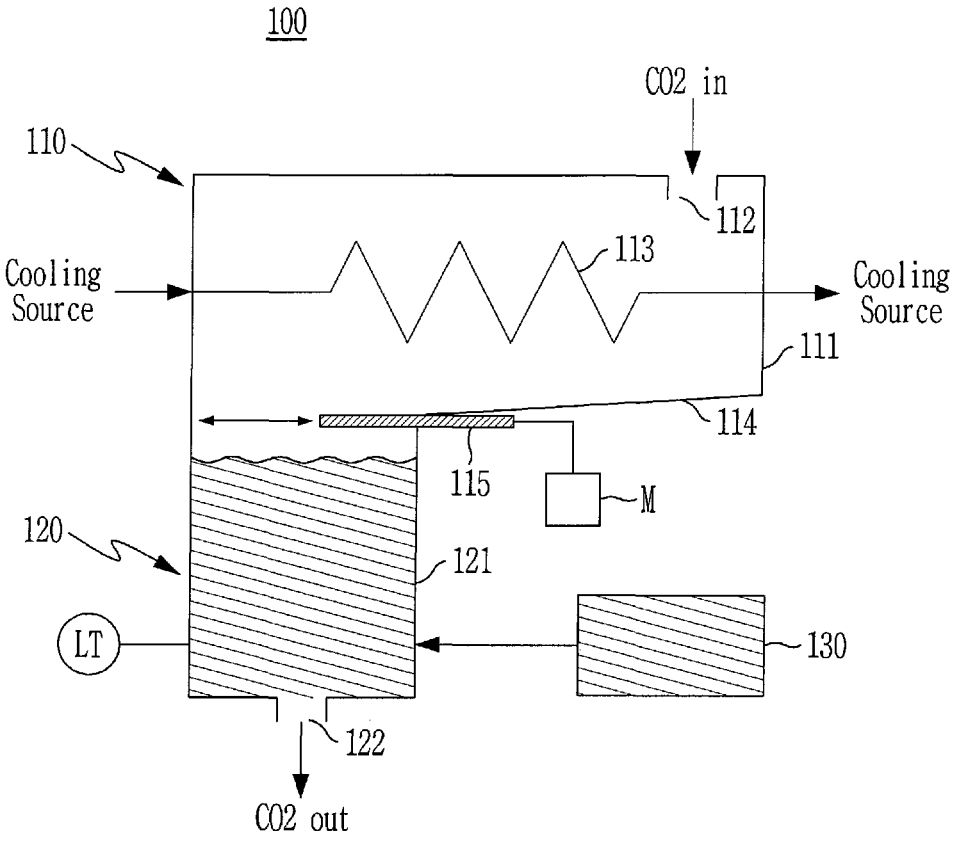

In addition, as shown in FIG. 4, the lower side of the cooler unit housing 111 may be provided with an opening and closing unit 115. In this embodiment, the opening and closing unit 115 may move horizontally to selectively open and close the buffer unit 120. The opening and closing unit 115, which may be made of an insulating material, enables the prevention of a liquid-phase working fluid stored in the buffer unit 120 from being evaporated by a gas-phase working fluid that is not yet in a cooled state and then flowing back to the cooler unit 110. The opening and closing unit 115 may be controlled by a motor M or an actuator (not shown). In FIG. 4, the opening and closing unit 115 is shown as being provided to the lower side of the cooler unit housing 111. However, the present invention is not limited thereto. The opening and closing unit 115 may be provided to the upper side of the buffer unit housing 121.

The buffer unit 120 may be provided under the cooler unit 110 such that the upper part of the buffer unit 120 is open. Specifically, the buffer unit housing 121, the upper part of which is open, may be integrally formed with the cooler unit housing 111, a portion of the lower part of which is open. A working fluid outlet port 122 is formed in a lower side or lower part of the buffer unit housing 121 of the buffer unit 120.

The buffer unit 120 receives and stores the liquid-phase working fluid that has been cooled by the cooler unit 110, and supplies the liquid-phase working fluid to the outside through the working fluid outlet port 122. For example, the stored liquid-phase working fluid may be supplied to the fluid pump 200 through the working fluid outlet port 122.

The buffer unit housing 121 of the buffer unit 120 extends downward from the upper, open part communicating with the cooler unit 110. As shown in FIG. 2, illustrating a section of the buffer unit, the buffer unit 120 may be configured such that the length L1 (height) of a lateral side of the buffer unit housing 121 is larger than the length L2 (width) of the lower side of the buffer unit housing 121. In this way, the aspect ratio of the buffer unit 120 is set to be greater than 1, to facilitate control of the level of the liquid-phase working fluid stored in the buffer unit 120. A conventional cooler is configured such that, when viewing a section of the cooler, the lower side is longer than the lateral side. As a result, the working fluid cooled by the cooling source gathers on the wide, lower inner surface of the cooler, whereby the level of the working fluid in the cooler is low. Consequently, any ripples or waves present in the surface of the liquefied working fluid act to impede an accurate control of the level of the stored working fluid in the conventional cooler, and therefore it is difficult to control the amount of working fluid supplied to the fluid pump 200.

In the embodiment of the present invention, the working fluid cooled by the cooling source gathers in the buffer unit 120 having a relatively high aspect ratio, which effectively increases the level of the working fluid in the buffer unit 120. Consequently, it is possible to reduce the effect of surface rippling or waves present in the working fluid. In addition, since the level of the working fluid stored in the buffer unit 120 is high, it is possible to easily control the amount of working fluid to be supplied to the fluid pump 200 through the working fluid outlet port 122 formed in the lower part of the buffer unit 120. Controlling the amount of working fluid to be supplied to the fluid pump 200 through the working fluid outlet port 122 may be performed by a control valve (not shown).

A level measurement unit (level transmitter) LT for measuring the level of the liquid-phase working fluid stored in the buffer unit 120 of the cooling module may be connected to the buffer unit 120. For a stable supply of the working fluid, it is necessary for the working fluid in the buffer unit 120 to be maintained at a predetermined level. If the level of the working fluid in the buffer unit 120 drops below the predetermined level, a liquid-phase working fluid may be further supplied to the buffer unit 120, by replenishing the buffer unit 120 with a liquid-phase working fluid from an outside source. To this end, in the embodiment of the present invention, an auxiliary supply unit 130 is provided in order to supply a liquid-phase working fluid to the buffer unit 120.

A controller (not shown) of the supercritical fluid power generation system compares the measurement value obtained by the level measurement unit LT with a predetermined level and controls the auxiliary supply unit 130 to supply the buffer unit 120 with an amount of working fluid equivalent to the difference value.

Figure 5:
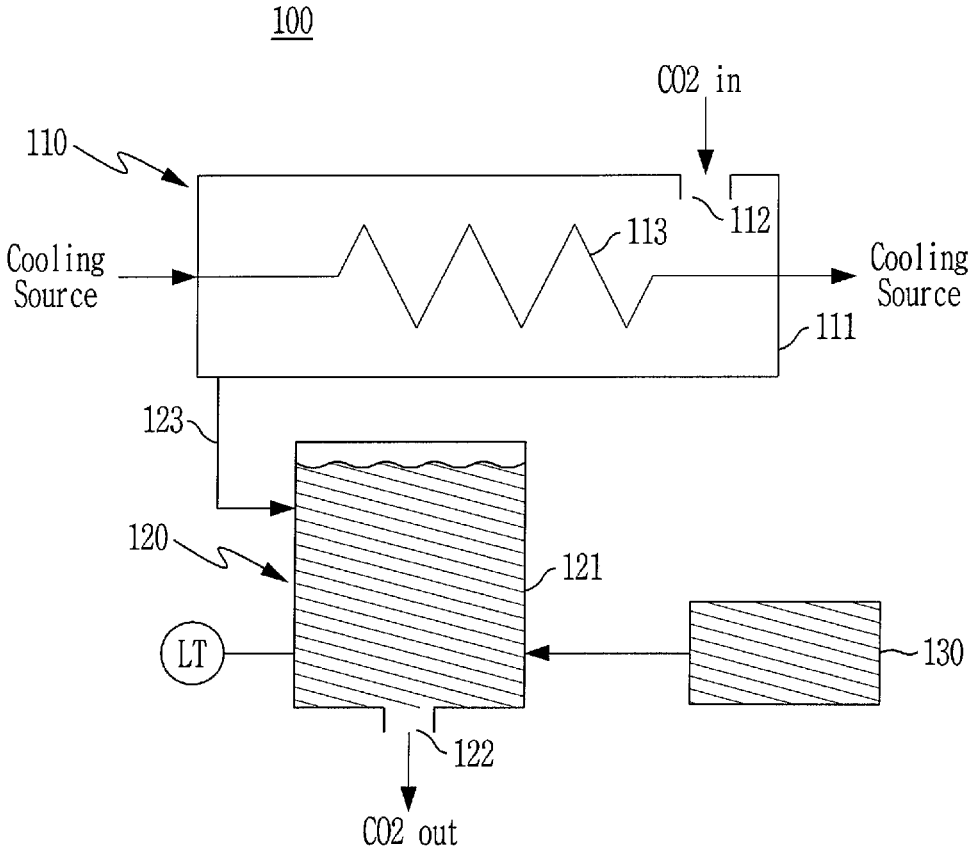
Figure 6:
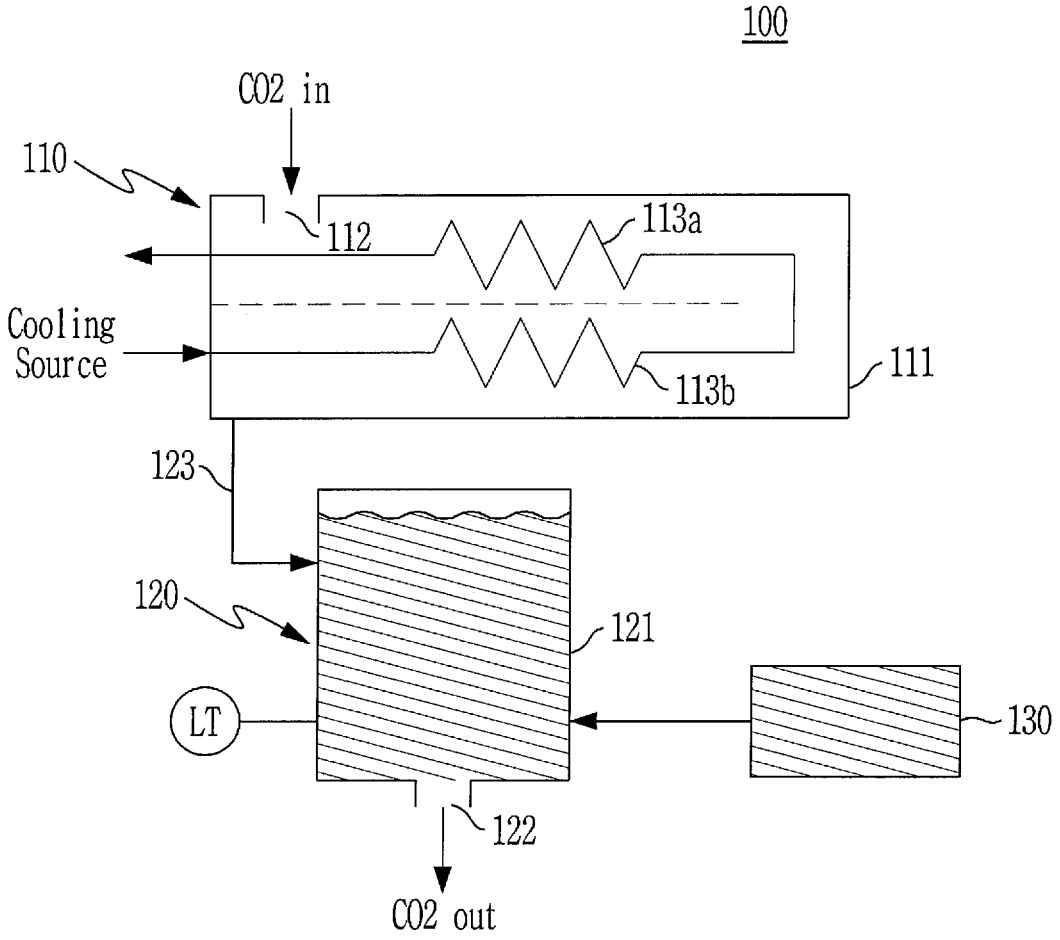

FIGS. 2 to 4 show the cooler unit 110 and the buffer unit 120 being integrally formed. Alternatively, as shown in FIGS. 5 and 6, the cooler unit 110 and the buffer unit 120 may be separately provided and thus are configured so as to be spaced apart from each other. In the configuration of FIG. 5, the cooler unit 110 adopts the straight-line type cooling source flow unit 113 (as in FIG. 2). In the configuration of FIG. 6, the cooler unit 110 adopts the U-shaped type cooling source flow unit 113 (as in FIG. 3). In this case, a transport pipe 123 for transporting the liquid-phase working fluid cooled by the cooler unit 110 to the buffer unit 120 is provided between the cooler unit 110 and the buffer unit 120. That is, the lower part of the cooler unit housing 111 communicates with the upper part of the buffer unit housing 121 via the transport pipe 123. The cooler unit 110 and the buffer unit 120 being spaced apart from each other, as in the configuration of FIG. 5 or 6, may obviate the need for the opening and closing unit 115.

Figure 7:
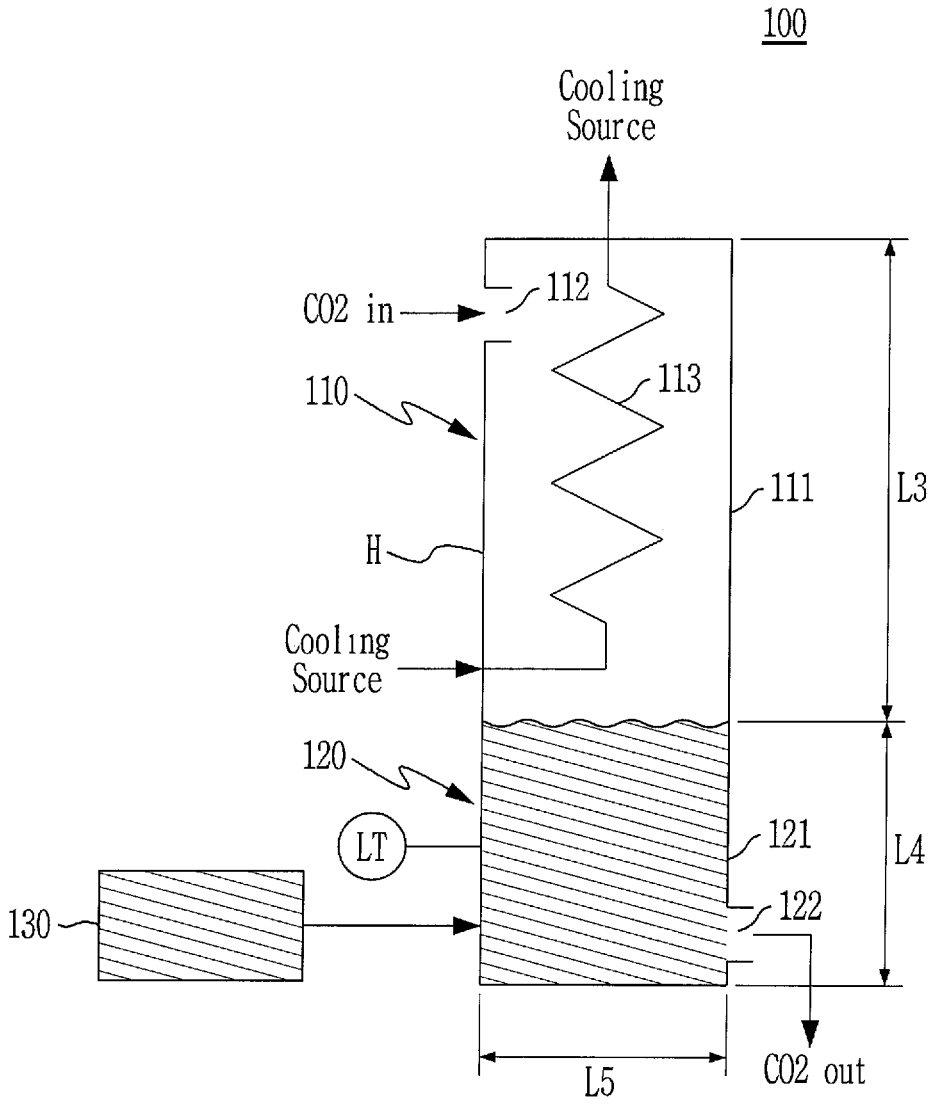
FIG. 7 is a diagram of a cooling module according to a second embodiment of the present invention.
Figure 8:
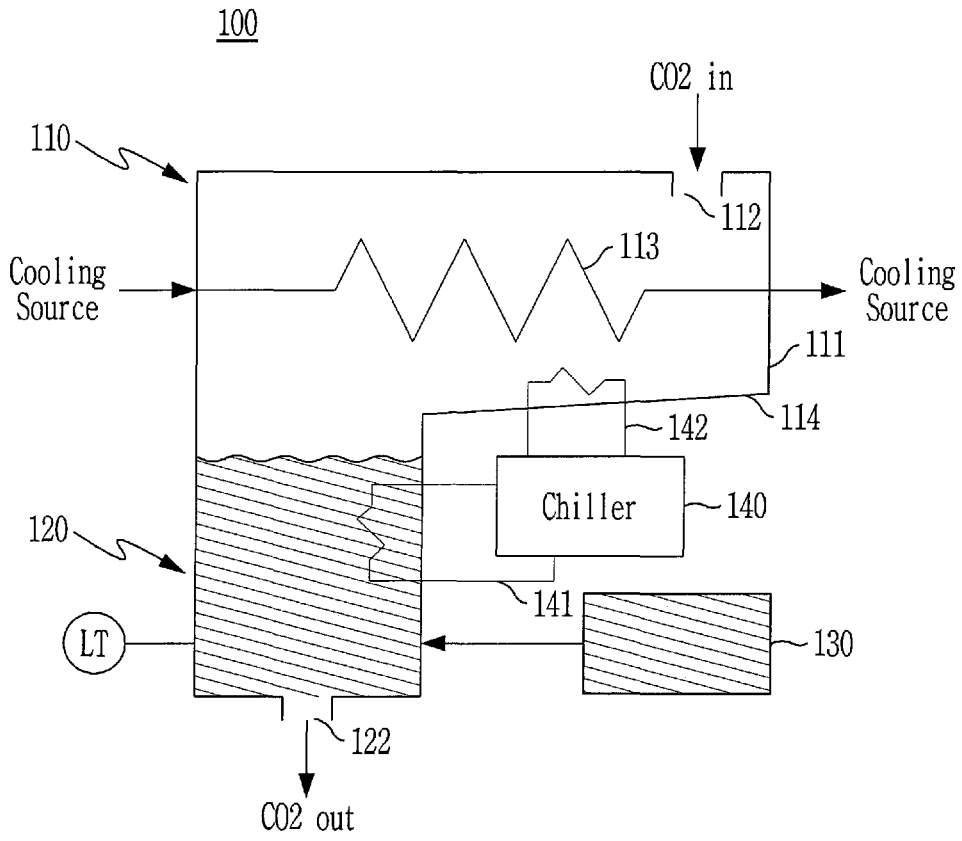
FIGS. 8 to 12 are diagrams showing various examples of a cooling module according to a third embodiment of the present invention.
Figure 9:
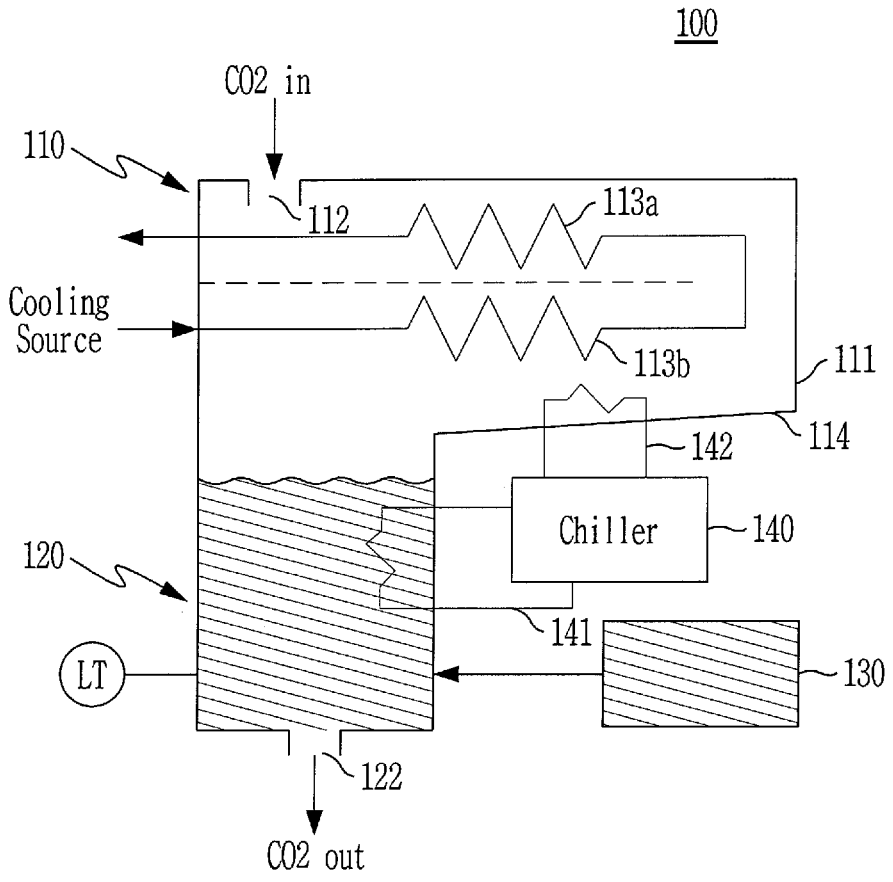
Figure 10:
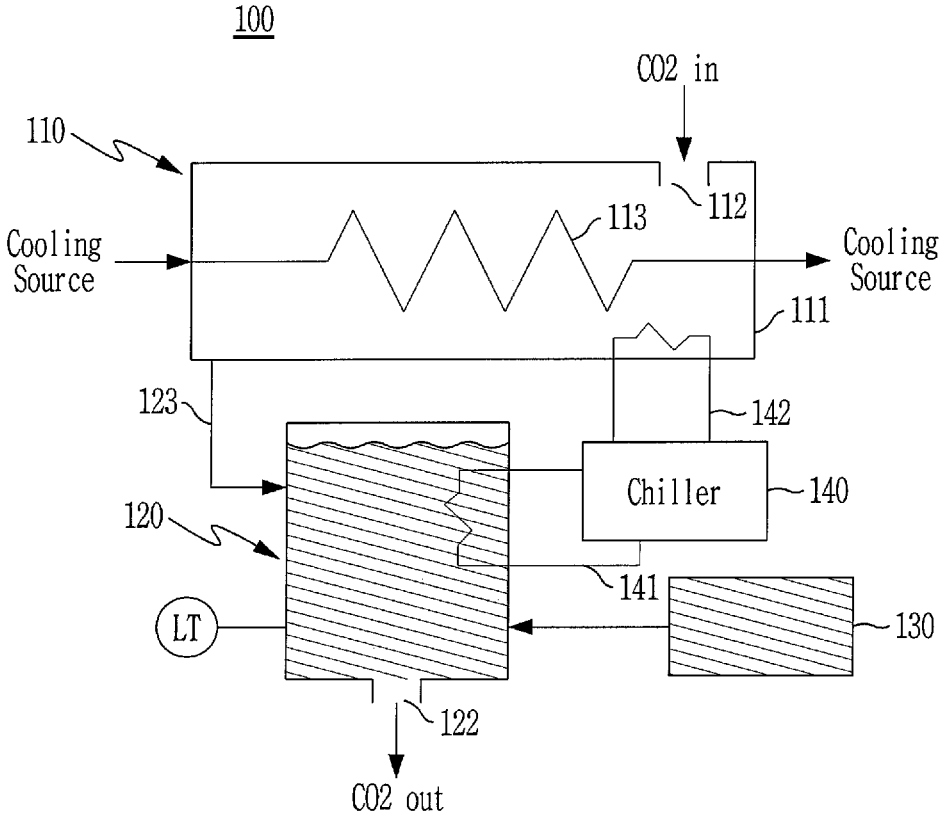
Figure 11:
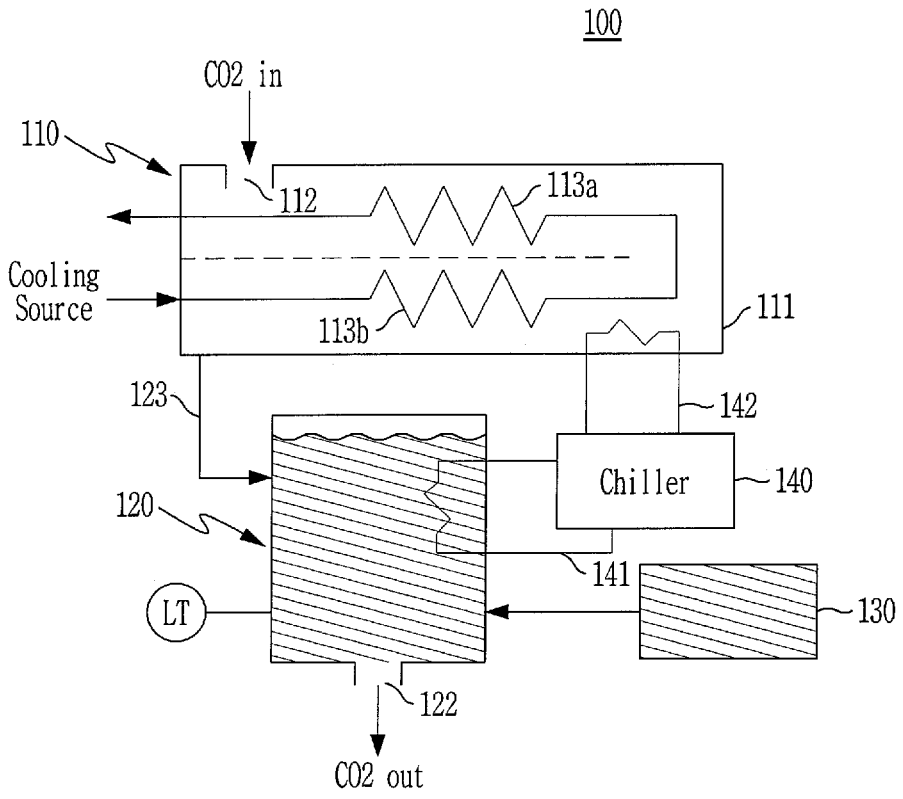
Figure 12:
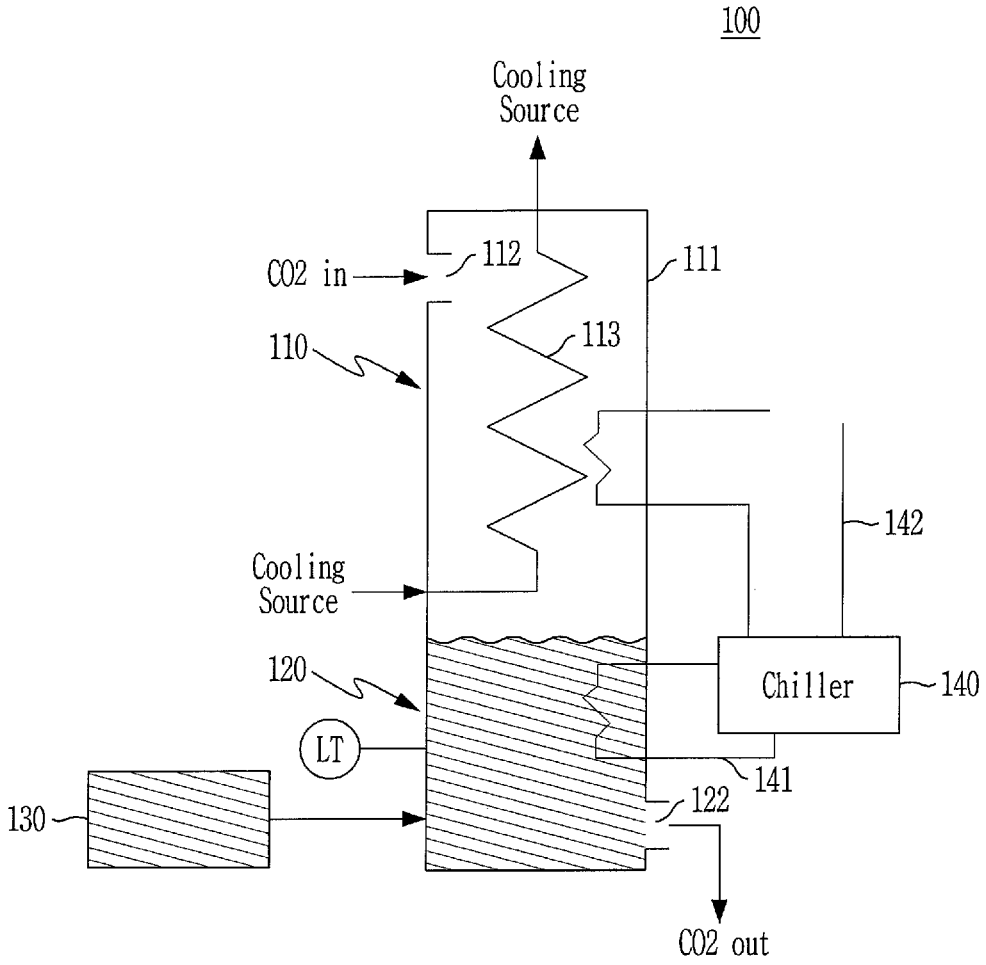

FIG. 7 shows a cooling module according to a second embodiment of the present invention.

As shown in FIG. 7, the cooling module according to the second embodiment of the present invention includes a housing H for embodying the cooler unit 110 and the buffer unit 120.

The cooling module according to this embodiment is configured to have a vertical type structure, unlike the first embodiment described above. In this embodiment, the housing H extends downward. The upper part of the housing H constitutes the cooler unit 110, and the lower part of the housing H constitutes the buffer unit 120.

The cooler unit 110 has a working fluid inlet port 112 and a cooling source flow unit 113. In this embodiment, the working fluid inlet port 112 is formed in an upper part of the housing H. The cooling source flow unit 113 is configured such that a cooling source supplied from the outside flows upward from a cooling source inlet provided in a lateral side of the housing H. Specifically, the inlet of the cooling source flow unit 113 formed in the lateral side of the housing H is disposed so as to be lower than the working fluid inlet port 112, and the outlet of the cooling source flow unit 113 is formed in the upper side or upper part of the housing H. The outlet of the cooling source flow unit 113 may be disposed so as to be higher than the working fluid inlet port 112.

The buffer unit 120 may be provided under the cooler unit 110 such that an upper, open side of the buffer unit 120 communicates with a lower, open part of the cooler unit 110. A working fluid outlet port 122 is formed in a lateral side of the lower part of the buffer unit 120. The cooler unit 110 and the buffer unit 120 are integrally formed to constitute the housing H.

In the cooling module 100 according to this embodiment, the lower part of the cooler unit housing 111 of the cooler unit 110 and the upper part of the buffer unit housing 121 of the buffer unit 120 are integrally formed, such that a length L3 of a lateral side of the cooler unit 110 and a length L4 of a lateral side of the buffer unit 120 combine to make the overall length (height) of the cooling module. To achieve a high aspect ratio, the sum of the length L3 and the length L4 may be larger than a length L5 (width) of the lower part of the buffer unit 120. More specifically, the length IA may be larger than the length L5.

In this embodiment, the cooling module may also have a level measurement unit LT for measuring the level of a liquid-phase working fluid stored in the buffer unit 120 and an auxiliary supply unit 130 for supplying a liquid-phase working fluid to the buffer unit 120.

A gas-phase working fluid is introduced through the working fluid inlet port 112 and, while flowing downward, performs heat exchange with a cooling source flowing in the cooling source flow unit 113, which is itself flowing upward. As a result, the gas-phase working fluid undergoes a phase change into a liquid-phase working fluid, which is stored in the buffer unit 120.

The buffer unit 120 stores the liquid-phase working fluid that has been cooled by the cooler unit 110, and supplies the liquid-phase working fluid to the outside through the working fluid outlet port 122. For example, the stored liquid-phase working fluid may be supplied to the fluid pump 200 through the working fluid outlet port 122. In this embodiment, though not specifically shown, an opening and closing unit 115 may be provided in a configuration similar to that described in relation to FIG. 4.

In the cooling module according to the embodiment of FIG. 7, the working fluid cooled by the cooling source gathers in the buffer unit 120, which has a higher aspect ratio than a conventional horizontal type cooling module. The high aspect ratio translates into a high level of the working fluid stored in the buffer unit 120. Consequently, it is possible to reduce the effect of surface rippling or waves present in the liquefied working fluid. In addition, since the level of the working fluid stored in the buffer unit 120 is high, it is possible to easily control the amount of working fluid to be supplied to the fluid pump 200 through the working fluid outlet port 122 formed in the lower part of the buffer unit 120.

Next, a cooling module according to a third embodiment of the present invention will be described with reference to FIGS. 8 to 12, respectively showing configurations of the cooling module 100.

As shown in FIGS. 8 to 12, the cooling module according to the third embodiment of the present invention further includes an auxiliary cooler unit 140 (chiller) having refrigerant flow paths 141 and 142, unlike the cooling module according to either of the first and second embodiments described above.

A cooling source, or refrigerant, is stored in the auxiliary cooler unit 140. The cooling source of the auxiliary cooler unit 140 may be liquid or gas having a lower temperature than a liquid-phase working fluid. For example, the cooling source may be liquefied natural gas (LNG) or water.

The cooling source stored in the auxiliary cooler unit 140 may flow to, and within, the buffer unit 120 and the cooler unit 110 along the refrigerant flow paths 141 and 142, respectively. Each of the refrigerant flow paths 141 and 142 is formed, for example, in the shape of a pipe. The cooling source performs heat exchange with the working fluid outside the pipe while flowing in the pipe.

If the amount of cooling source flowing in the cooling source flow unit 113 is insufficient during the operation of the system, a surplus gas-phase working fluid may be introduced into the buffer unit 120 without being cooled by the cooler unit 110. The auxiliary cooler unit 140 cools the surplus gas-phase working fluid in order to improve the cooling efficiency of the cooling module.

In addition, during the operation of the system, it is possible for the auxiliary cooler unit 140 to prevent a liquid-phase working fluid stored in the buffer unit 120 from being evaporated by heat generated from the system or by external heat and then flowing back to the cooler unit 110.

In addition, if the amount of cooling source flowing in the cooling source flow unit 113 is insufficient during the operation of the system, the auxiliary cooler unit 140 may perform further heat exchange through the portion of the refrigerant flow path 142 that is located in the cooler unit 110, whereby it is possible to improve the cooling efficiency of the cooling module.

In addition, when the system is stopped, heat exchange is continuously performed through the portion of the refrigerant flow path 141 that is located in the buffer unit 110, whereby it is possible to prevent the liquid-phase working fluid stored in the buffer unit 120 from being evaporated by heat generated from the system or by external heat.

Next, a cooling module according to a fourth embodiment of the present invention will be described with reference to FIGS. 13 to 23, respectively showing configurations of the cooling module 100.

The cooling module 100 according to the fourth embodiment of the present invention is configured such that a cooling source first performs heat exchange with a working fluid stored in a buffer unit 120 and then performs heat exchange with a working fluid introduced into a cooler unit 110 in order to improve the cooling efficiency of the cooling module.

As shown, the cooling module 100 according to the fourth embodiment of the present invention includes a cooler unit 110, a buffer unit 120, and a cooling source flow unit 1000. The cooler unit 110 and the buffer unit 120 are substantially the same as the cooler unit and the buffer unit of the first embodiment described above, respectively, and therefore a detailed description thereof will be omitted.

Figure 14:
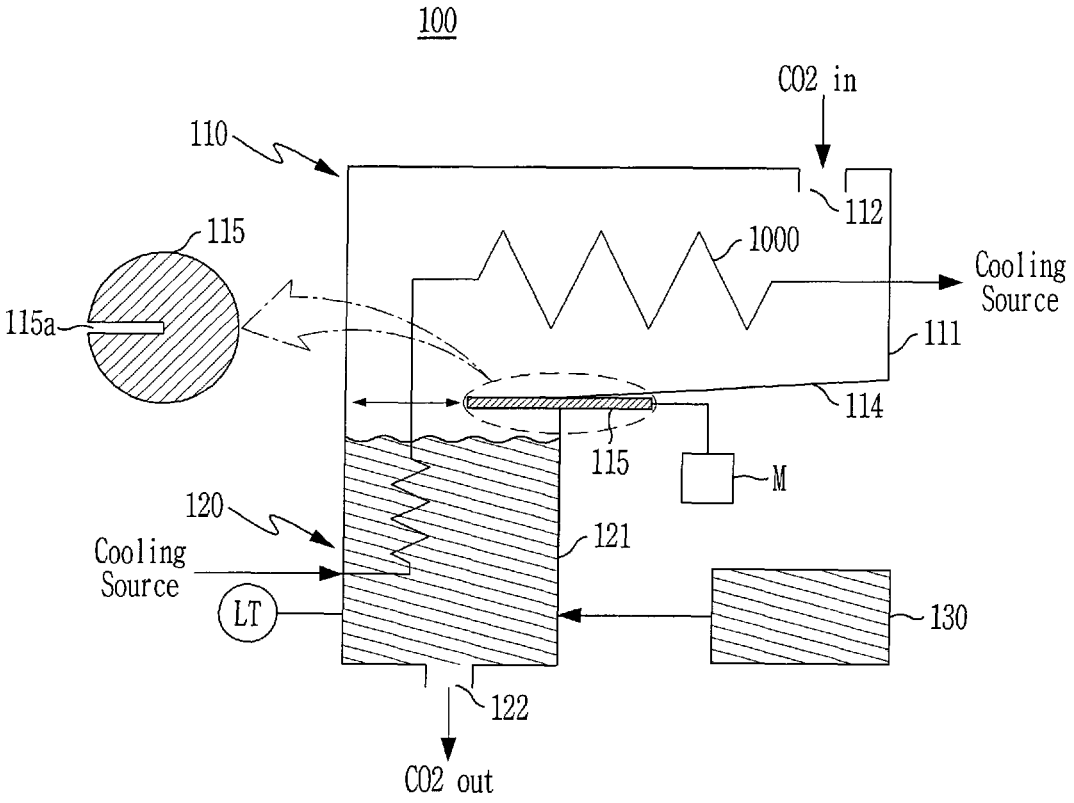

One exception to the cooler and buffer units being the same, however, applies to configurations of the cooling module 100 in which the respective housing units are integrally formed. That is, an opening and closing unit 115 may be provided with a slot 115*a* through which the cooling source flow unit 1000 can pass, as shown in FIG. 14. Consequently, the cooling source flow unit 1000 is not affected by a horizontal movement of the opening and closing unit 115 to selectively open and close the top of the buffer unit 120.

According to the fourth embodiment, the cooling source flow unit 1000 is configured to pass, sequentially, first through the buffer unit 120 and then through the cooler unit 110, by entering via the buffer unit housing 121 and exiting via the cooler unit housing 111. A cooling source supplied from the outside flows in the buffer unit 120 and the cooler unit 110 through the cooling source flow unit 1000. The cooling source flow unit 1000 is formed, for example, in the shape of a pipe. The cooling source performs heat exchange with a working fluid outside the pipe while flowing in the pipe. The cooling source may be liquid or gas having a lower temperature than the working fluid. For example, the cooling source may be liquefied natural gas (LNG) or water.

Figure 13:
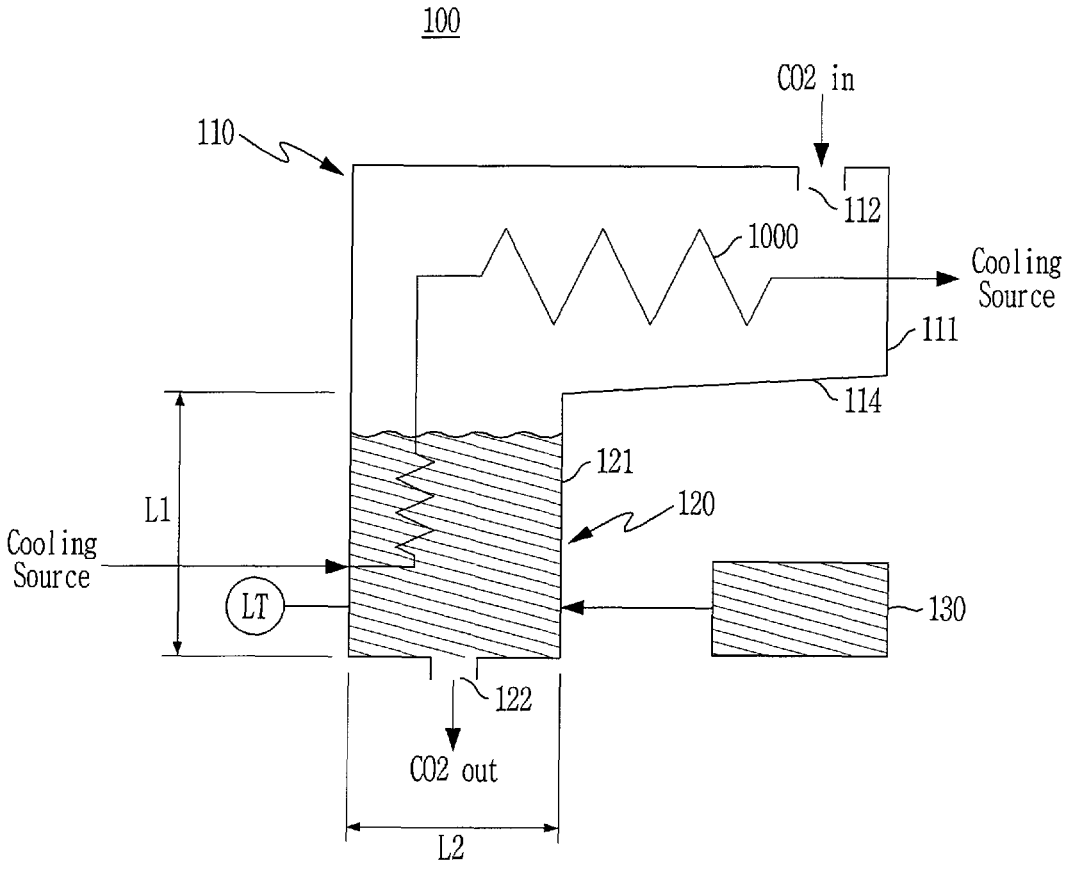
FIGS. 13 to 23 are diagrams showing various examples of a cooling module according to a fourth embodiment of the present invention.
Figure 15:
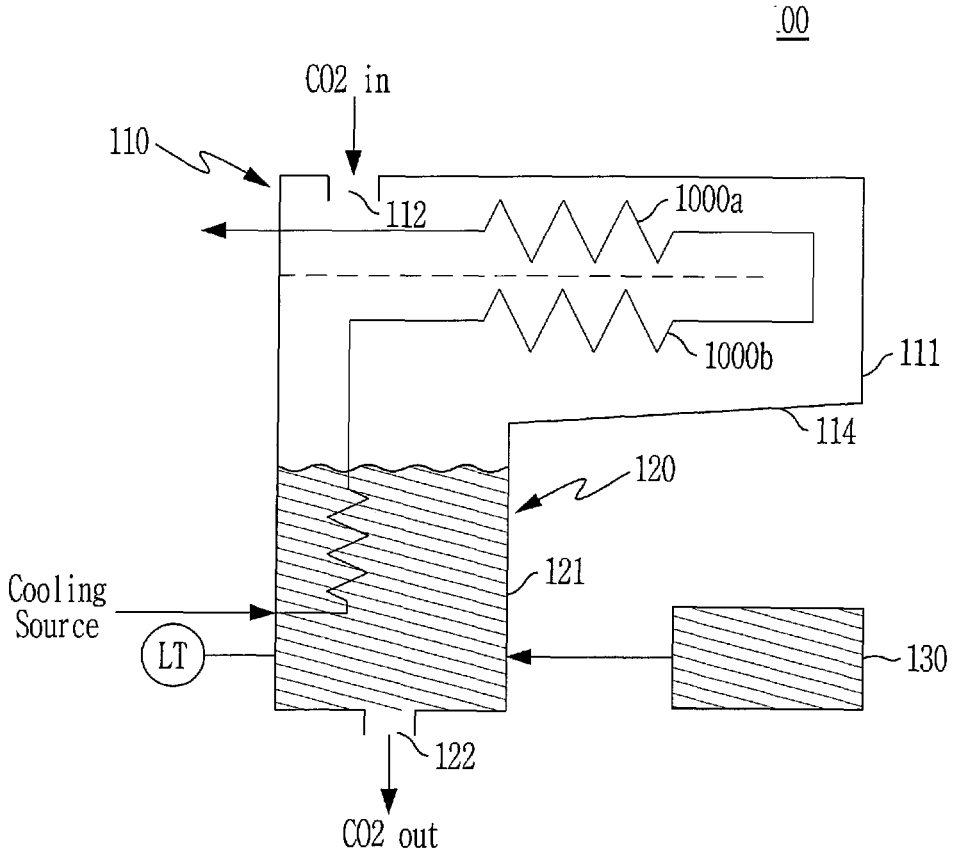

As shown in FIG. 13, the cooling source flow unit 1000 may be configured such that the cooling source is introduced through one lateral side of the buffer unit housing 121 and is discharged through the opposite lateral side of the cooler unit housing 111. Alternatively, as shown in FIG. 15, illustrating a U-shaped type cooling source flow unit, the cooling source flow unit 1000 may be configured such that the cooling source is introduced through a lateral side of the buffer unit housing 121 and is discharged through the same lateral side of the cooler unit housing 111. Here, the portion of the cooling source flow unit 1000 that is located in the cooler unit 110 has a U-shaped configuration.

When the cooling source flow unit 1000 is configured as in FIG. 13, the working fluid inlet port 112 may be formed at a position above which the buffer unit 120 is not disposed, i.e., the second position described in relation to FIG. 2. When the cooling source flow unit 1000 is configured as in FIG. 15, the working fluid inlet port 112 may be formed at a position above which the buffer unit 120 is disposed, i.e., the first position described in relation to FIG. 3.

A U-shaped type cooling source flow unit 1000 may include an upper flow unit 1000*a* and a lower flow unit 1000*b*, as shown in FIG. 15. The cooling source that flows in the upper flow unit 1000*a* may first perform heat exchange with the working fluid that is introduced through the working fluid inlet port 112, and the cooling source that flows in the lower flow unit 1000*b* may then perform heat exchange with the working fluid that has performed heat exchange with the cooling source in the upper flow unit 1000*a*.

At this time, the cooling source may be introduced into the lower flow unit 1000*b* via the buffer unit 120 and may then flow to the upper flow unit 1000*a*. Since the cooling source undergoes heat exchange in the lower flow unit 1000*b* and then undergoes heat exchange in the upper flow unit 1000*a*, the temperature of the cooling source that flows in the upper flow unit 1000*a* is higher than the temperature of the cooling source that flows in the lower flow unit 1000*b*. The working fluid introduced through the working fluid inlet port 112 performs primary heat exchange with the cooling source that flows in the upper flow unit 1000*a*, and then performs secondary heat exchange with the cooling source that flows in the lower flow unit 1000*b*. The working fluid performs heat exchange with a relatively high-temperature cooling source, and then performs heat exchange with a relatively low-temperature cooling source. That is, primary heat exchange is performed, adjacent to the upper flow unit 1000*a*, between a high-temperature working fluid that has not undergone heat exchange and a high-temperature cooling source that has undergone heat exchange, and secondary heat exchange is performed, adjacent to the lower flow unit 1000*b*, between a low-temperature working fluid that has undergone heat exchange and a low-temperature cooling source that has not undergone heat exchange, whereby heat exchange efficiency may be improved.

Figure 16:
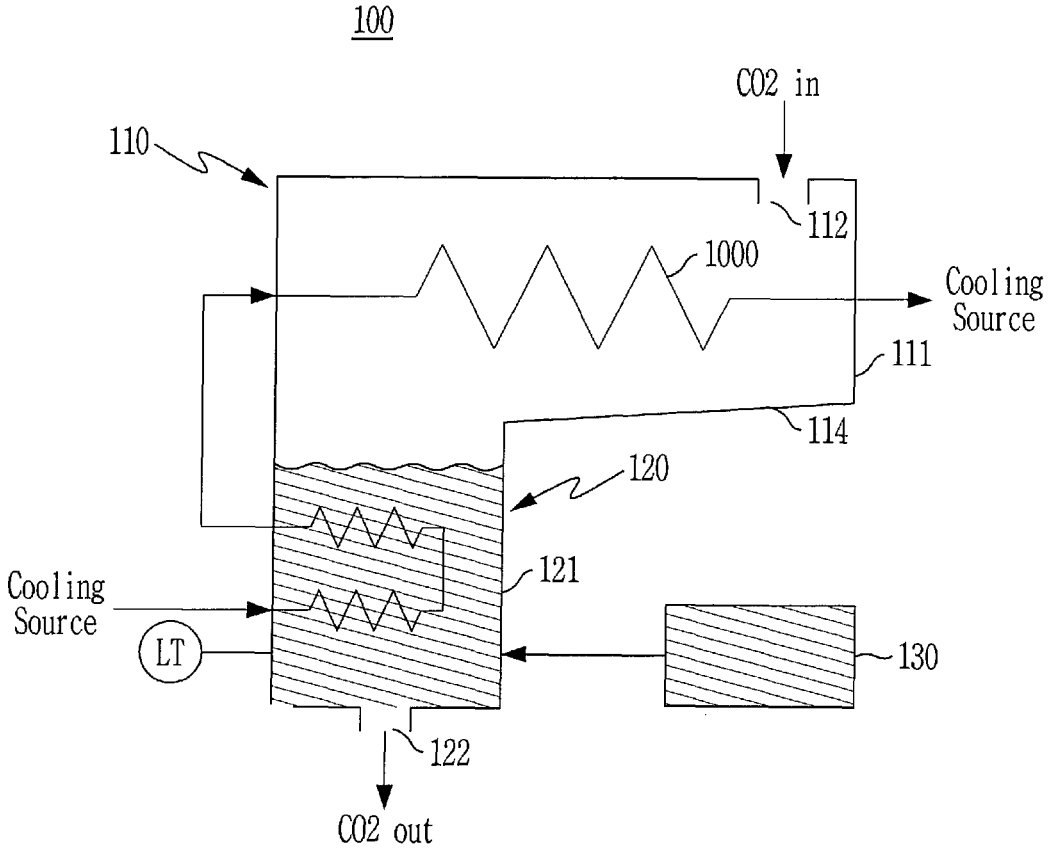
Figure 17:
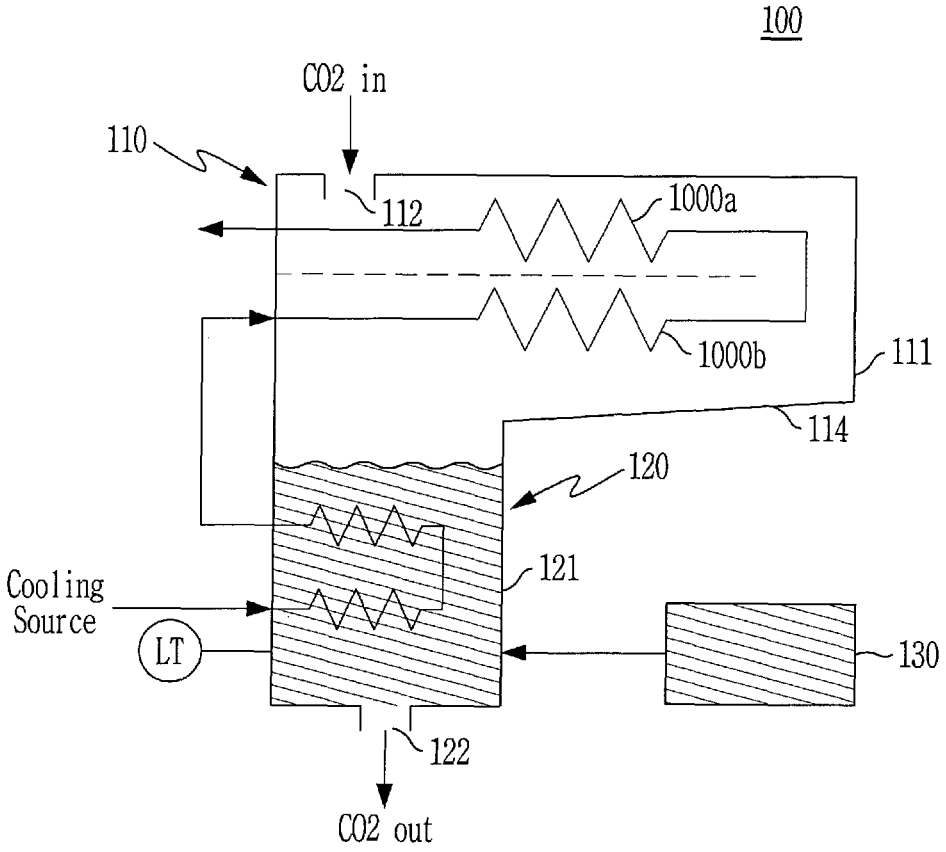

In the cooling module 100 shown in FIG. 16, the portion of the cooling source flow unit 1000 that is located in the buffer unit 120 has a U-shaped configuration. In the cooling module shown in FIG. 17, the portions of the cooling source flow unit 1000 respectively located in the cooler unit 110 and the buffer unit 120 each have a U-shaped configuration. Here, the makeup and operation of the U-shaped type cooling source flow unit 1000 is identical to what has been described above, and therefore a detailed description thereof will be omitted.

Figure 18:
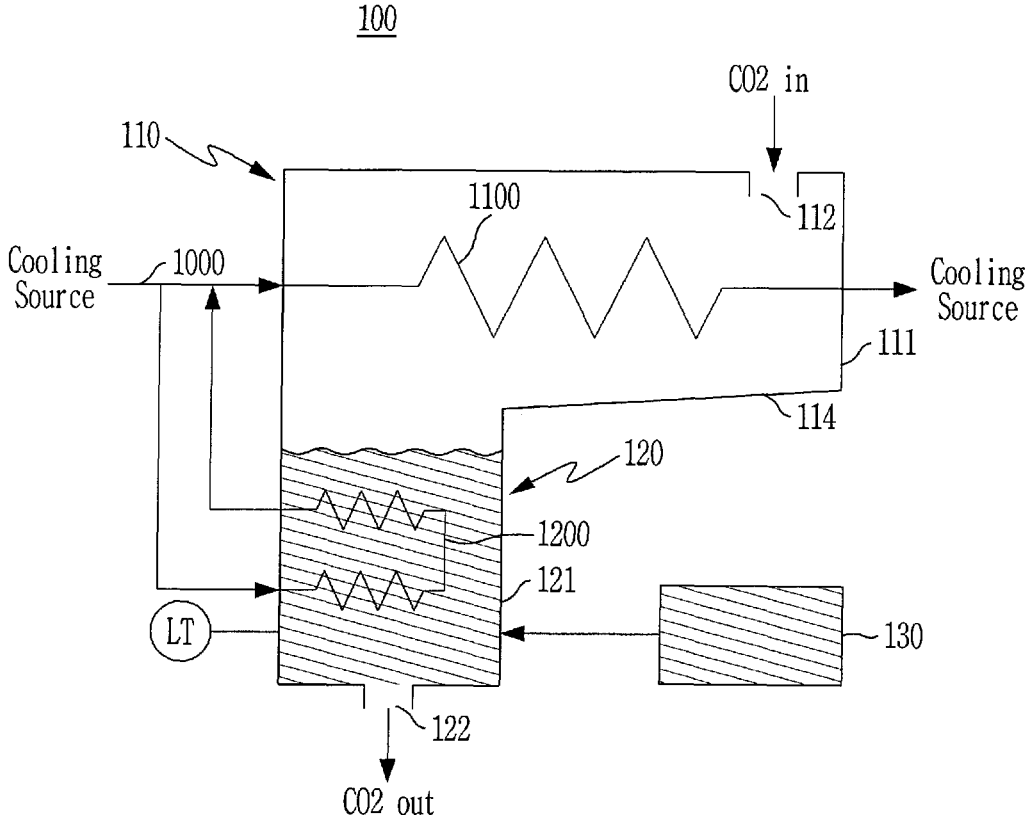

In the cooling module 100 shown in FIG. 18, the cooling source flow unit 1000 branches into a cooler-side flow unit 1100 and a buffer-side flow unit 1200. A part of the cooling source flowing in the cooling source flow unit 1000 flows to the branched buffer-side flow unit 1200 and performs heat exchange with the working fluid stored in the buffer unit 120 and thereafter flows again to the cooling source flow unit 1000. The cooling source flowing in the buffer-side flow unit 1200 first performs heat exchange with the working fluid stored in the buffer unit 120, and then joins the cooling source flowing in the cooler-side flow unit 1100.

Figure 19:
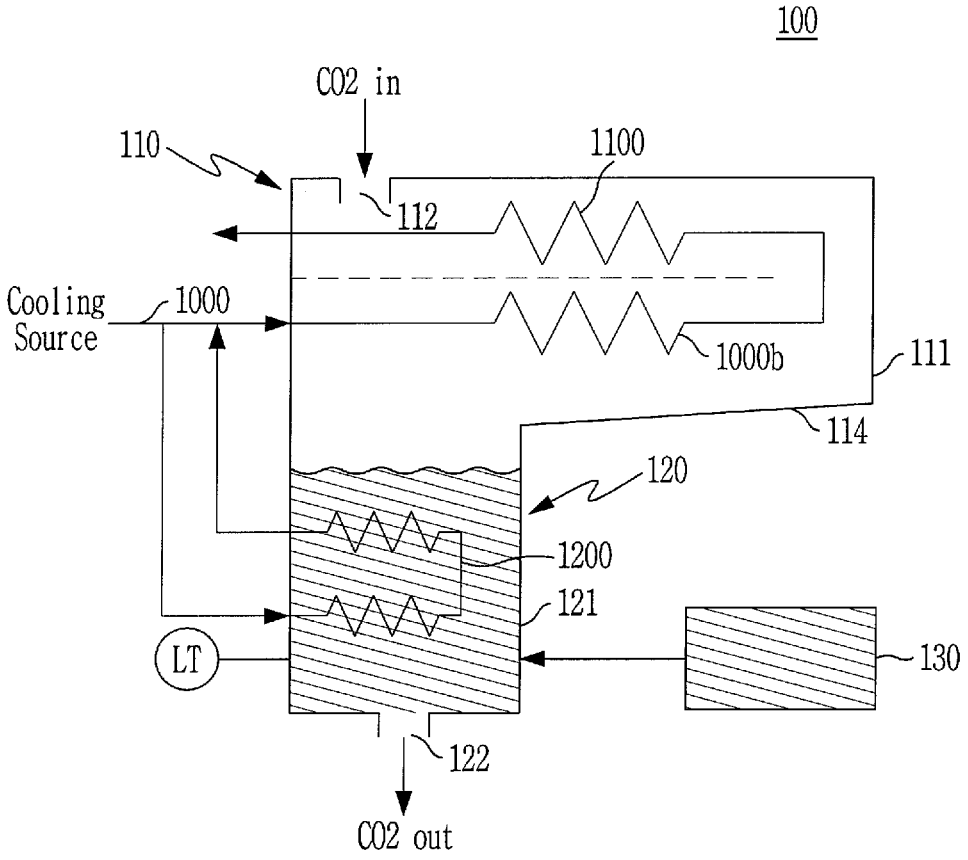

FIG. 19 shows that the cooler-side flow unit 1100 of the cooling module 100 of FIG. 18 may have a U-shaped configuration.

FIGS. 13 to 19 show that the cooler unit 110 and the buffer unit 120 may be integrally formed. Alternatively, as shown in FIGS. 20 and 23, the cooler unit 110 and the buffer unit 120 may be separately provided so as to be spaced apart from each other, in which case a transport pipe 123 for transporting a liquid-phase working fluid cooled by the cooler unit 110 to the buffer unit 120 is provided between the cooler unit 110 and the buffer unit 120.

Figure 20:
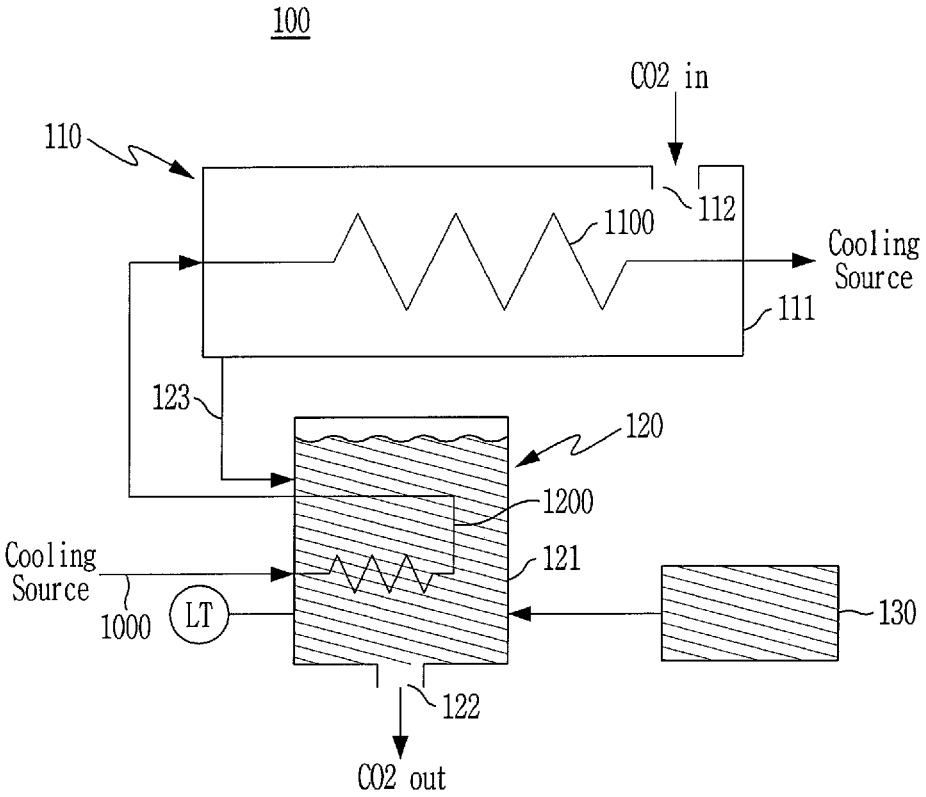
Figure 21:
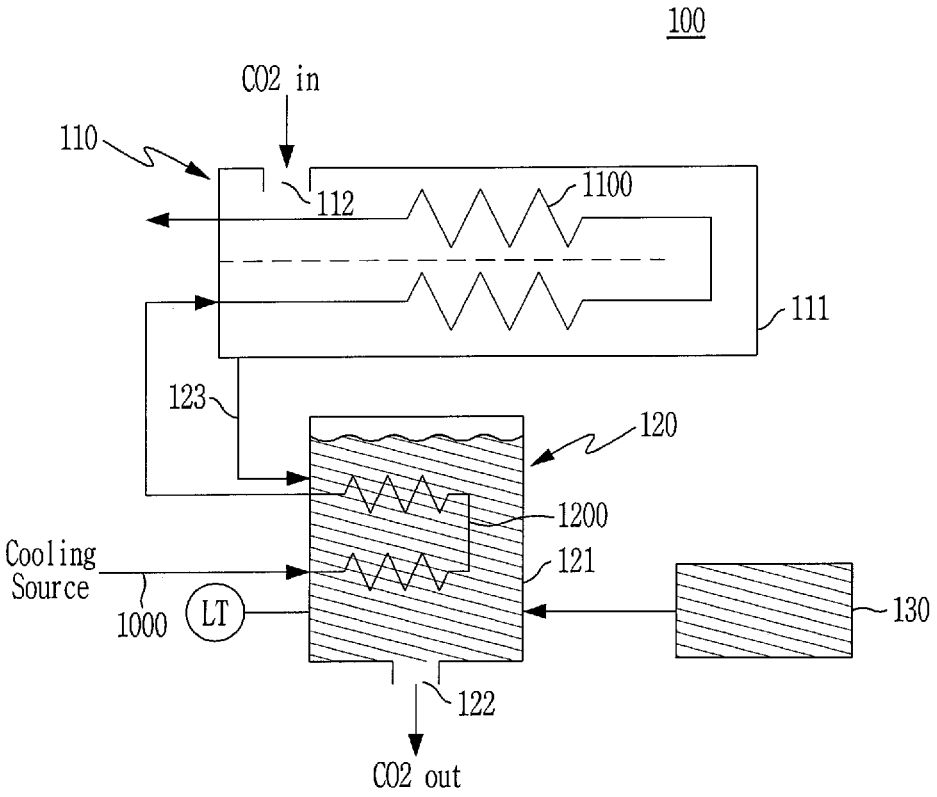

FIG. 20 shows a cooling module 100 in which the cooler unit 110 and the buffer unit 120 are separately provided and the cooling source flow unit 1000 disposed in the buffer unit 120 has a U-shaped configuration, and FIG. 21 shows a cooling module 100 in which the cooler unit 110 and the buffer unit 120 are spaced apart from each other and the cooling source flow unit 1000 respectively disposed in the cooler unit 110 and the buffer unit 120 each have a U-shaped configuration.

Figure 22:
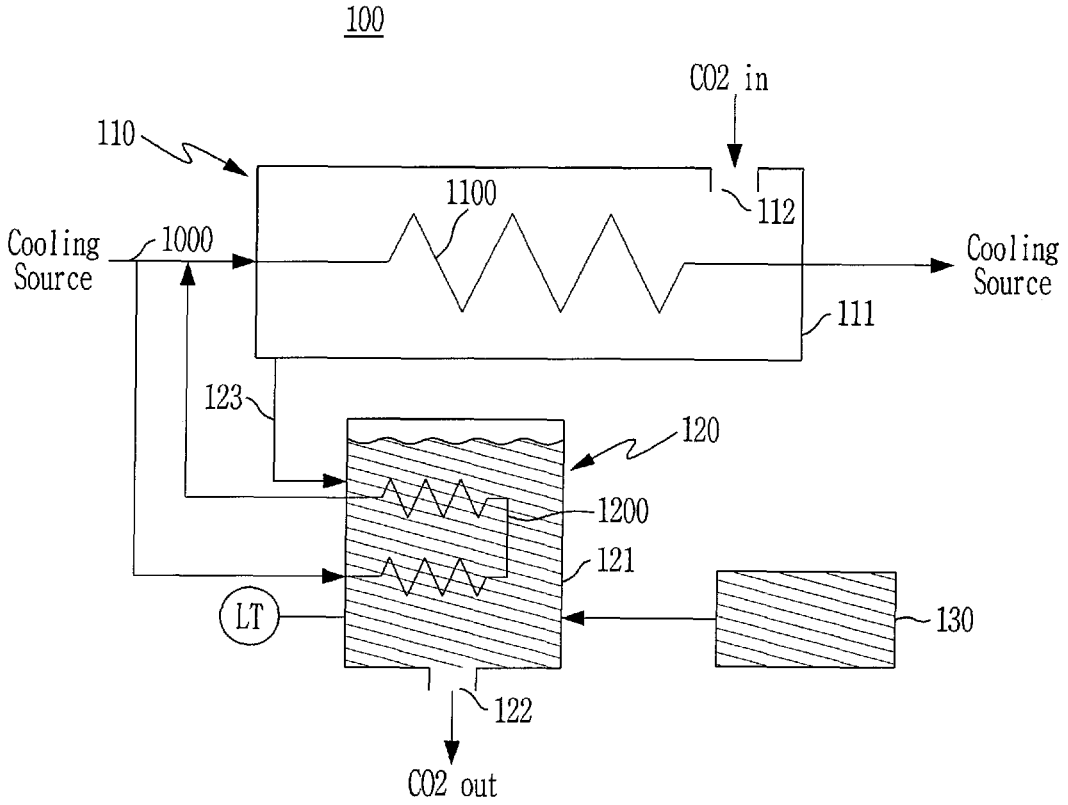

The cooling module shown in FIG. 22 is configured such that the cooler unit 110 and the buffer unit 120 are spaced apart from each other and such that the cooling source flow unit 1000 branches into a cooler-side flow unit 1100 and a buffer-side flow unit 1200. A part of the cooling source flowing in the cooling source flow unit 1000 flows to the branched buffer-side flow unit 1200 and performs heat exchange with the working fluid stored in the buffer unit 120 and thereafter flows again to the cooling source flow unit 1000. The cooling source flowing in the buffer-side flow unit 1200 first performs heat exchange with the working fluid stored in the buffer unit 120, and then joins the cooling source flowing in the cooler-side flow unit 1100.

Figure 23:
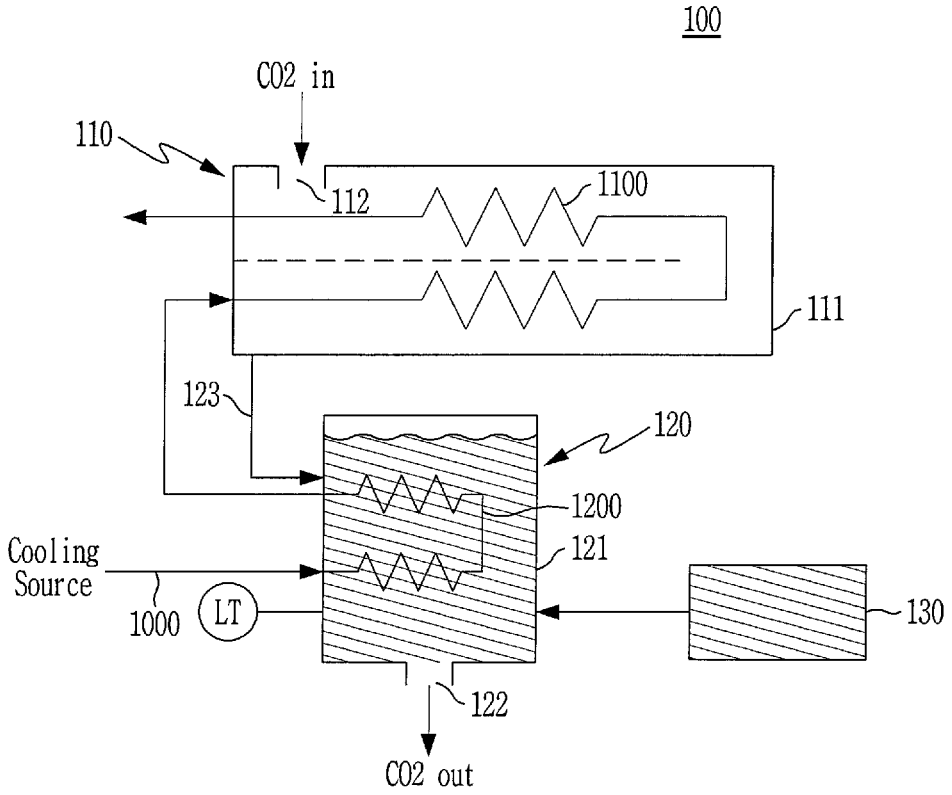

FIG. 23 shows that the cooler-side flow unit 1100 of the cooling module 100 of FIG. 22 may have a U-shaped configuration.

In the cooling module 100 of each of FIGS. 20 to 23, the cooler unit 110 and the buffer unit 120 are spaced apart from each other. Thus, without an opening and closing unit 115, it is possible to prevent a liquid-phase working fluid stored in the buffer unit 120 from being evaporated by external heat and then flowing back to the cooler unit 110 when the operation of the supercritical fluid power generation system is stopped.

Next, a cooling module according to a fifth embodiment of the present invention will be described with reference to FIGS. 24 to 27, respectively showing configurations of the cooling module 100.

The cooling module 100 according to the fifth embodiment of the present invention is configured such that a cooling source simultaneously performs heat exchange with the working fluid in a cooler unit 110 and with the working fluid in a buffer unit 120 in order to improve the cooling efficiency of the cooling module.

As shown, the cooling module according to the fifth embodiment of the present invention includes a cooler unit 110, a buffer unit 120, and a cooling source flow unit 2000. The cooler unit 110 and the buffer unit 120 are identical to the cooler unit and the buffer unit of the fourth embodiment described above, respectively, and therefore a detailed description thereof will be omitted.

Figure 24:
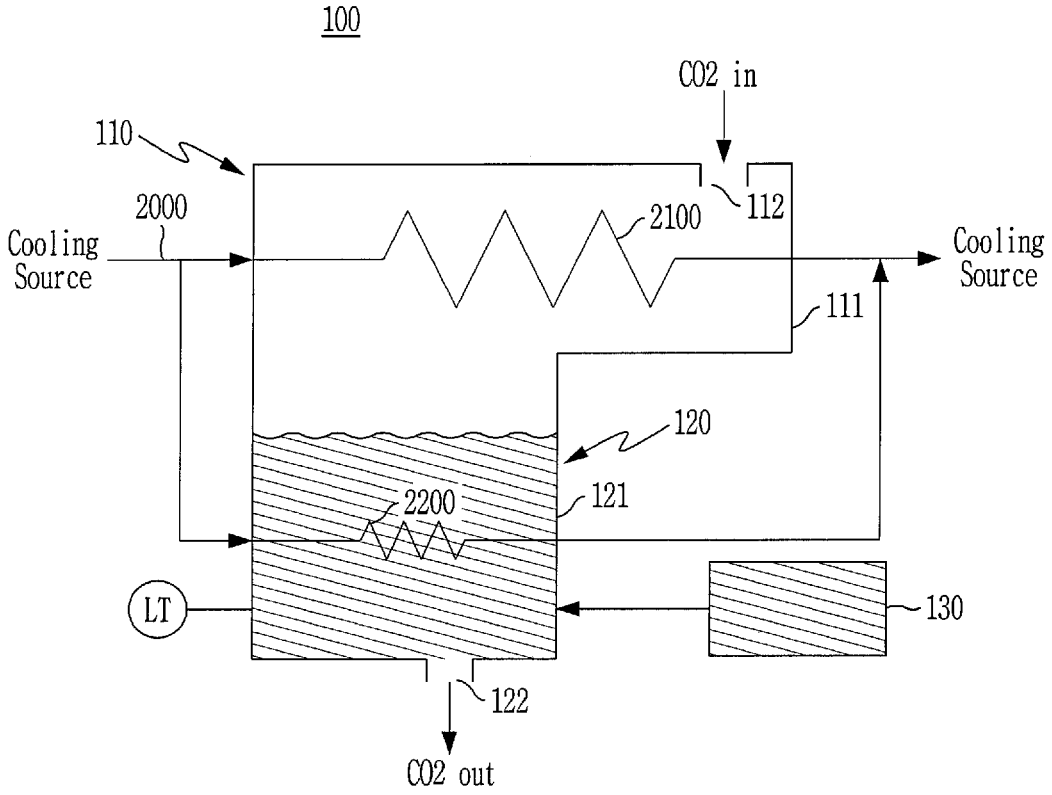
FIGS. 24 to 27 are diagrams showing various examples of a cooling module according to a fifth embodiment of the present invention.

As shown in FIG. 24, the cooling source flow unit 2000 branches into a cooler-side flow unit 2100 and a buffer-side flow unit 2200. The cooler-side flow unit 2100 is disposed in the cooler unit 110, and the buffer-side flow unit 2200 is disposed in the buffer unit 120. The cooler-side flow unit 2100 and the buffer-side flow unit 2200 are connected to each other outside the housings 111 and 121.

A cooling source flowing in the cooler-side flow unit 2100 performs heat exchange with a working fluid introduced into the cooler unit 110 through a working fluid inlet port 112 such that the working fluid undergoes a phase change into a liquid phase.

Meanwhile, a cooling source flowing in the buffer-side flow unit 2200 performs heat exchange with a liquid-phase working fluid stored in the buffer unit 120 in order to prevent the liquid-phase working fluid stored in the buffer unit 120 from being evaporated. The cooling source flowing in the buffer-side flow unit 2200 may also cool a surplus gas-phase working fluid introduced into the buffer unit without being cooled by the cooler unit 110. Accordingly, it is possible to improve the cooling efficiency of the cooling module.

Figure 25:
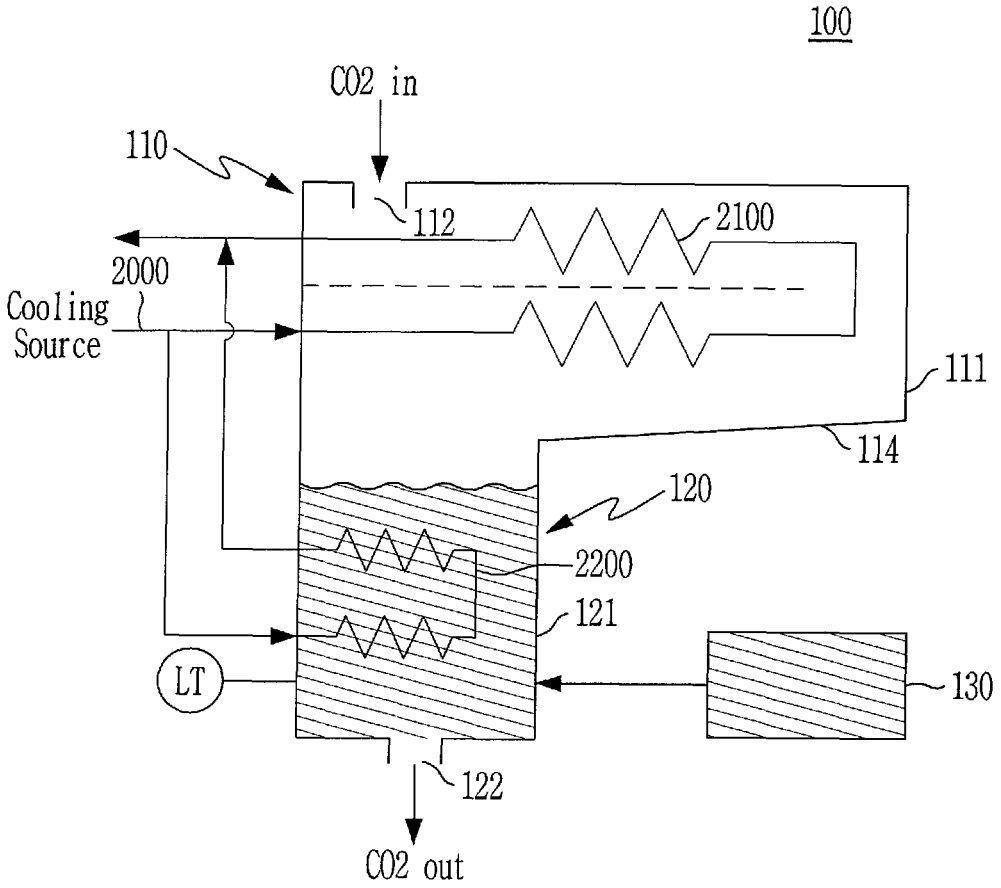

FIG. 25 shows a cooling module 100 in which the cooler-side flow unit 2100 disposed in the cooler unit 110 and the buffer-side flow unit 2200 disposed in the buffer unit 120 both have a U-shaped configuration.

Figure 26:
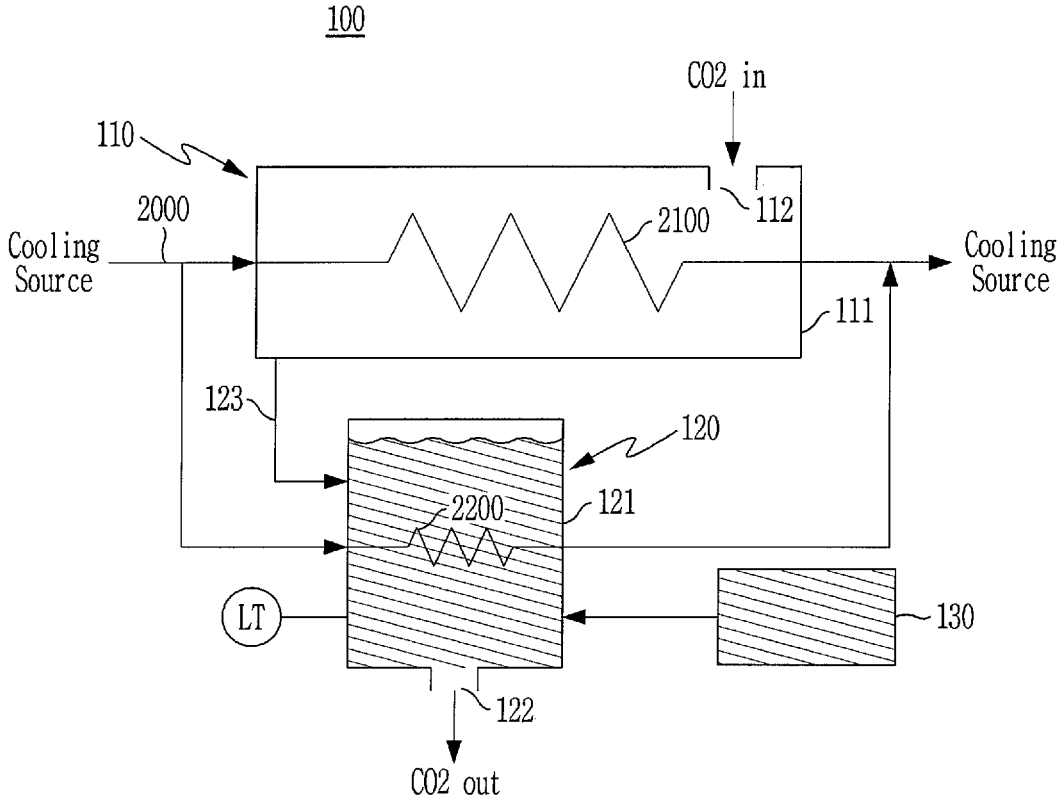
Figure 27:
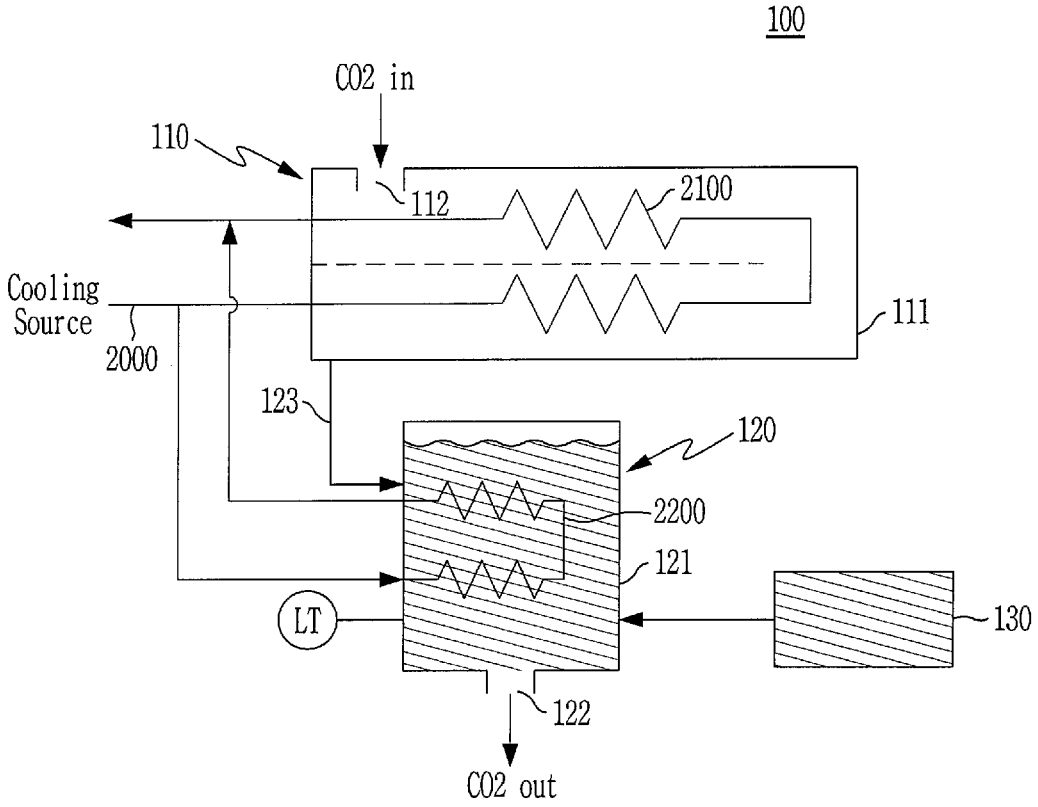

The cooling module 100 in either of FIGS. 26 and 27 is configured such that the cooler unit 110 and the buffer unit 120 are spaced apart from each other, such that the cooler-side flow unit 2100 is disposed in the cooler unit 110, and such that the buffer-side flow unit 2200 is disposed in the buffer unit 120. In FIG. 26, the cooling source is distributed to the cooler-side flow unit 2100 and the buffer-side flow unit 2200 such that the cooling source is introduced from one lateral side of each of the cooler unit 110 and the buffer unit 120 and flows to the opposite lateral side of each of the cooler unit 110 and the buffer unit 120. In the cooling module 100 of FIG. 27, the cooler-side flow unit 2100 disposed in the cooler unit 110 and the buffer-side flow unit 2200 disposed in the buffer unit 120 both have a U-shaped configuration.

In this embodiment, a level measurement unit LT for measuring the level of a liquid-phase working fluid stored in the buffer unit 120 and an auxiliary supply unit 130 for supplying a liquid-phase working fluid to the buffer unit 120 may also be provided, in the same manner as in the fourth embodiment described above.

Next, a cooling module 100 according to a sixth embodiment of the present invention will be described with reference to FIG. 28.

Figure 28:
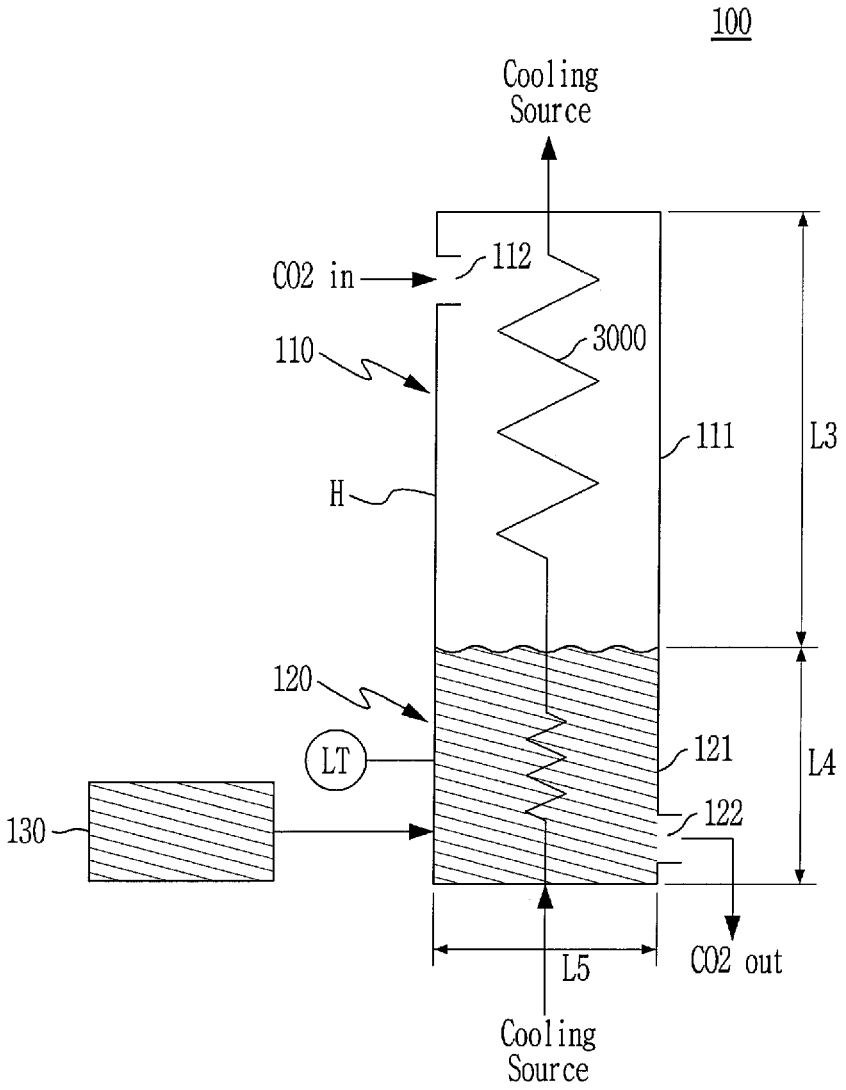
FIG. 28 is a diagram of a cooling module according to a sixth embodiment of the present invention.

As shown in FIG. 28, the cooling module 100 according to the sixth embodiment of the present invention includes a housing H, a cooler unit 110, a buffer unit 120, and a cooling source flow unit 3000.

The cooling module 100 according to this embodiment is configured to have a vertical type structure. In this embodiment, the housing H extends downward. The upper part of the housing H constitutes the cooler unit 110, and the lower part of the housing H constitutes the buffer unit 120. A working fluid inlet port 112 is formed in one lateral side of an upper part of the housing H constituting the cooler unit 110, and a working fluid outlet port 122 is formed in the opposite lateral side of a lower part of housing H constituting the buffer unit 120.

The cooling source flow unit 3000 is configured such that a cooling source supplied from the outside flows from the buffer unit 120, which is constituted by the lower part of the housing H, to the cooler unit 110, which is constituted by the upper part of the housing H. That is, the inlet of the cooling source flow unit 3000 is formed in the lower side of the housing H, and the outlet of the cooling source flow unit 3000 is formed in the upper side of the housing H.

The buffer unit 120 may be provided under the cooler unit 110 such that the upper part of the buffer unit 120 is open and communicates with the lower, open part of the cooler unit 110. The cooler unit 110 and the buffer unit 120 are integrally formed so as to constitute the housing H.

In the cooling module 100 according to this embodiment, the lower part of the cooler unit 110 and the upper part of the buffer unit 120 are integrally formed, such that a length L3 of the lateral side of the cooler unit 110 and a length L4 of the lateral side of the buffer unit 120 combine to make the overall length (height) of the cooling module. To achieve a high aspect ratio, the sum of the length L3 and the length L4 may be larger than a length L5 (width) of the lower part of the buffer unit 120. More specifically, the length L4 may be larger than the length L5.

In this embodiment, the cooling module 100 may also have a level measurement unit LT for measuring the level of a liquid-phase working fluid stored in the buffer unit 120 and an auxiliary supply unit 130 for supplying a liquid-phase working fluid to the buffer unit 120, in the same manner as in the previous embodiments.

A working fluid is introduced through the working fluid inlet port 112 and, while flowing downward, performs heat exchange with a cooling source flowing in the cooling source flow unit 3000, which is itself flowing upward. As a result, the working fluid undergoes a phase change into a liquid-phase working fluid, which is stored in the buffer unit 120.

The buffer unit 120 stores the liquid-phase working fluid that has been cooled by the cooler unit 110, and supplies the liquid-phase working fluid to the outside through the working fluid outlet port 122. For example, the stored liquid-phase working fluid may be supplied to the fluid pump 200 through the working fluid outlet port 122.

In the cooling module 100 according to this embodiment, the working fluid cooled by the cooling source gathers in the buffer unit 120, which has a higher aspect ratio than a conventional horizontal type cooling module. The high aspect ratio translates into a high level of the working fluid stored in the buffer unit 120. Consequently, it is possible to reduce the effect of surface rippling or waves present in the liquefied working fluid. In addition, since the level of the working fluid stored in the buffer unit 120 is high, it is possible to easily control the amount of working fluid to be supplied to the fluid pump 200 through the working fluid outlet port 122 formed in the lower part of the buffer unit 120. Furthermore, the cooling source flowing in the cooling source flow unit 3000 may perform heat exchange with the liquefied working fluid stored in the buffer unit 120 in order to prevent the working fluid from evaporating. Moreover, the cooling source flowing in the cooling source flow unit 3000 may cool a surplus gas-phase working fluid introduced into the buffer unit without being cooled by the cooler unit 110, whereby it is possible to improve the cooling efficiency of the cooling module.

Next, a cooling module according to a seventh embodiment of the present invention will be described with reference to FIGS. 29 to 31, respectively showing representative examples of configurations of the cooling module 100, in which an auxiliary cooler unit is further provided to previously described embodiments. Here, representative examples are included for embodiments corresponding to FIGS. 13, 16, and 28, respectively, but the seventh embodiment of the present invention should not be understood to be limited to these.

Figure 29:
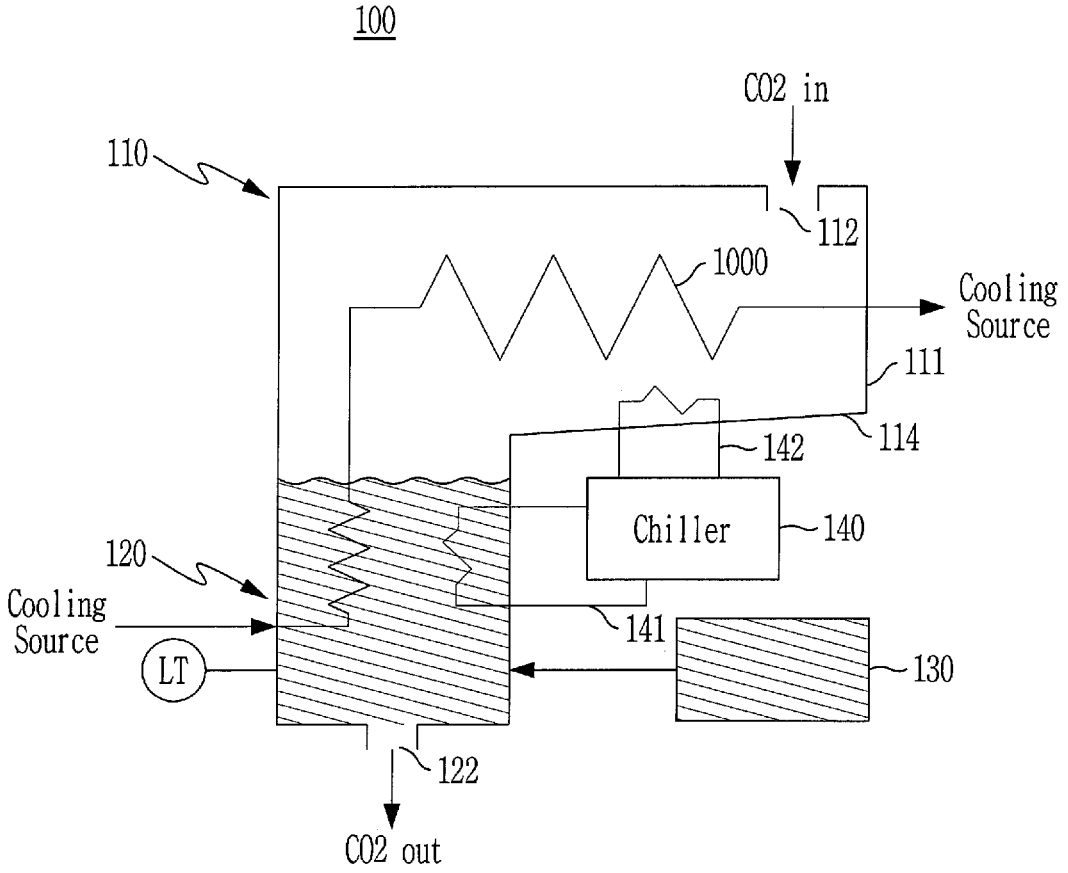
FIGS. 29 to 31 are diagrams showing various examples of a cooling module according to a seventh embodiment of the present invention.
Figure 30:
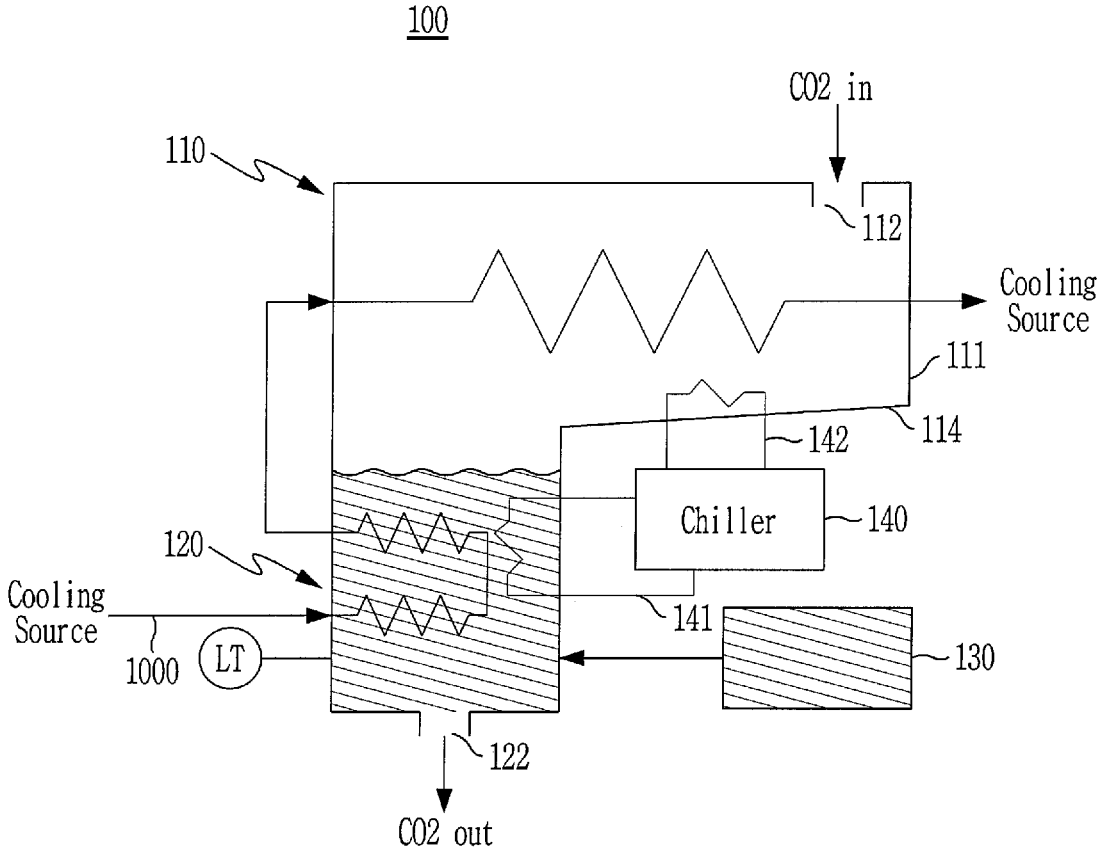
Figure 31:
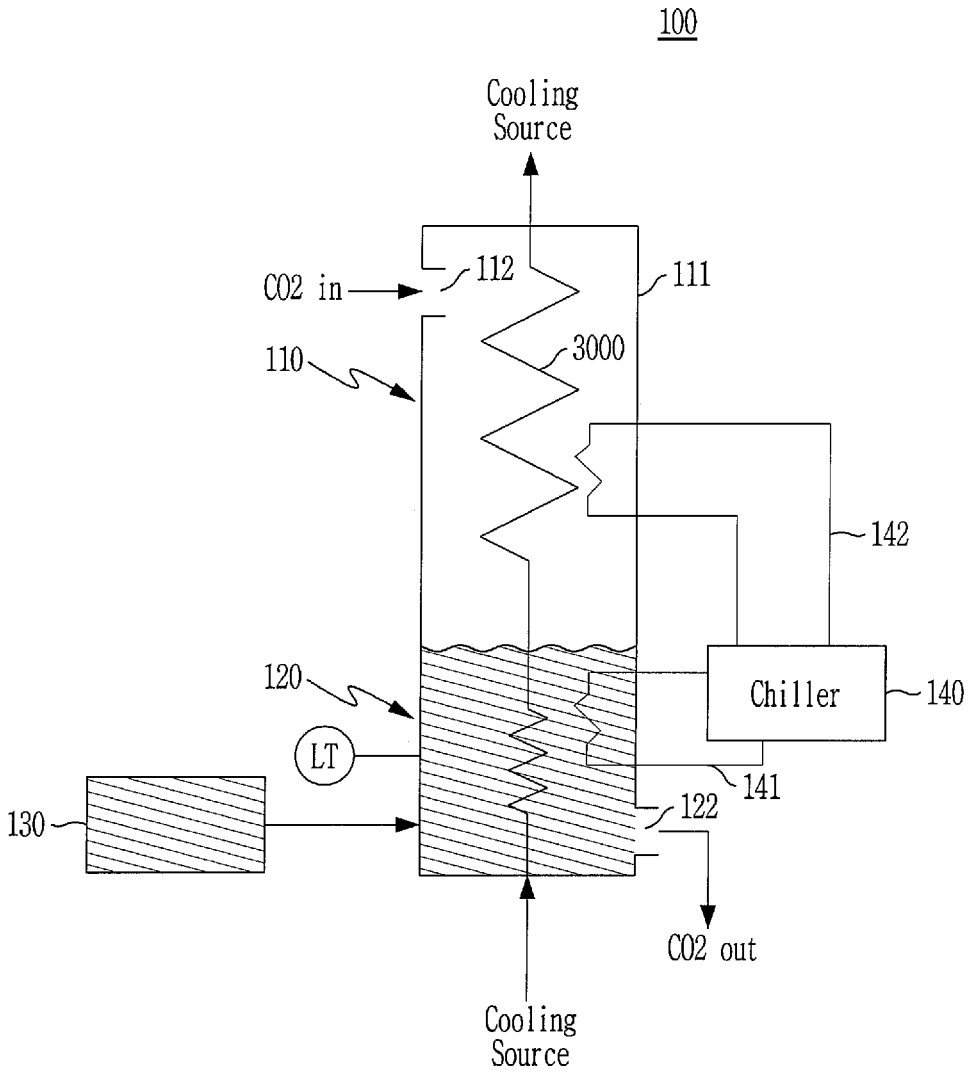

As shown in FIGS. 29 to 31, the cooling module 100 according to the seventh embodiment of the present invention further includes an auxiliary cooler unit 140 having refrigerant flow paths 141 and 142.

A cooling source is stored in the auxiliary cooler unit 140. The cooling source may be liquid or gas having a lower temperature than a working fluid. For example, the cooling source may be liquefied natural gas (LNG) or water.

The cooling source stored in the auxiliary cooler unit 140 may flow in the buffer unit 120 and the cooler unit 110 along the refrigerant flow paths 141 and 142, respectively. Each of the refrigerant flow paths 141 and 142 is formed, for example, in the shape of a pipe. The cooling source performs heat exchange with the working fluid outside the pipe while flowing in the pipe.

If the amount of cooling source flowing in the cooling source flow unit (113, 1000, 2000, 3000) is insufficient during the operation of the system, a surplus gas-phase working fluid may be introduced into the buffer unit 120 without being cooled by the cooler unit 110. The auxiliary cooler unit 140 cools the surplus gas-phase working fluid in order to improve the cooling efficiency of the cooling module.

In addition, during the operation of the system, it is possible for the auxiliary cooler unit 140 to prevent a liquid-phase working fluid stored in the buffer unit 120 from being evaporated by heat generated from the system or by external heat and then flowing back to the cooler unit 110.

In addition, if the amount of cooling source flowing in the cooling source flow unit is insufficient during the operation of the system, the auxiliary cooler unit 140 may perform further heat exchange through the portion of the refrigerant flow path 142 that is located in the cooler unit 110, whereby it is possible to improve the cooling efficiency of the cooling module.

In addition, when the system is stopped, heat exchange is continuously performed through the portion of the refrigerant flow path 141 that is located in the buffer unit 110, whereby it is possible to prevent the liquid-phase working fluid stored in the buffer unit 120 from being evaporated by heat generated from the system or by external heat.

Next, a method of cooling the supercritical fluid power generation system using the cooling module according to any of the embodiments of the present invention will be described.

In order to cool the supercritical fluid power generation system according to the embodiment of the present invention, a gas-phase working fluid is cooled into a liquid-phase working fluid. A gas-phase working fluid is introduced into the cooler unit 110 through the working fluid inlet port 112 formed in the cooler unit 110 from the outside (for example, the first heat exchanger 310). The gas-phase working fluid performs heat exchange with a cooling source flowing in the cooling source flow unit 113, 1000, 2000, or 3000. As a result, the gas-phase working fluid is cooled into a liquid-phase working fluid. In the case in which the amount of cooling source flowing in the cooling source flow unit 113, 1000, 2000, or 3000 is insufficient, additional heat exchange may be performed using a cooling source flowing in the refrigerant flow path 142.

Subsequently, the cooled working fluid, i.e., the liquid-phase working fluid, is stored in the buffer unit 120. The working fluid that has been cooled into a liquid-phase working fluid as the result of heat exchange with the cooling source flowing in the cooling source flow unit 113, 1000, 2000, or 3000 or as the result of additional heat exchange with the cooling source flowing in the refrigerant flow path 142 flows downward and is then stored in the buffer unit 120. At this time, the liquid-phase working fluid may be introduced into the buffer unit 120 along the lower surface or the inclined surface 114 of the cooler unit housing 111 and may then be stored in the buffer unit 120. The buffer unit 120 is configured such that the aspect ratio of the buffer unit 120 is greater than 1 in order to facilitate control of the level of the stored liquid-phase working fluid.

Since the working fluid introduced into the buffer unit 120 may contain a gas-phase working fluid that has not been cooled, the cooling source flowing in the portion of the refrigerant flow path 141 that is located in the buffer unit 120 performs heat exchange with the gas-phase working fluid such that the gas-phase working fluid undergoes a phase change into a liquid-phase working fluid. In addition, it is possible for the refrigerant flow path 141 to prevent the liquid-phase working fluid stored in the buffer unit 120 from being evaporated by heat generated from the system or by external heat. If the level of the working fluid in the buffer unit 120 drops below a predetermined level, a liquid-phase working fluid is supplied to the buffer unit 120 through the auxiliary supply unit 130 in order to stably supply the working fluid.

Meanwhile, according to each of the fourth to seventh embodiments of the present invention, some of the working fluid introduced into the buffer unit 120 that has not cooled is cooled by the cooling source flow unit 1000, 2000, or 3000 disposed in the buffer unit 120. If the amount of cooling source in the cooling source flow unit 1000, 2000, or 3000 is insufficient, the cooling source flowing in the portion of the refrigerant flow path 141 that is located in the buffer unit 120 performs heat exchange with a surplus gas-phase working fluid such that the gas-phase working fluid undergoes a phase change into a liquid-phase working fluid.

The liquid-phase working fluid stored in the buffer unit 120 is supplied to the fluid pump 200. The fluid pump 200 compresses the working fluid to make the working fluid enter a low-temperature and high-pressure state. The working fluid flows through various transport pipes of the supercritical fluid power generation system.

As is apparent from the above description, according to an embodiment of the present invention, stable supply of a working fluid is achieved in a supercritical fluid power generation system.

Although embodiments have been described with reference to a number of illustrative embodiments thereof those skilled in the art will appreciate that the present invention can be variously modified and altered through the addition, change, or deletion of components without departing from the idea of the invention as disclosed in the accompanying claims and that such modifications and alterations fall within the scope of rights of the present invention.

What is claimed is:

1. A cooling module comprising:

a cooling source flow unit in which a cooling source supplied from an outside flows;

a cooler unit configured to enable a gas-phase working fluid introduced through a working fluid inlet port to undergo a phase change into a liquid-phase working fluid by performing heat exchange with the cooling source flowing in the cooling source flow unit;

a buffer unit provided under the cooler unit and configured to receive and store the liquid-phase working fluid cooled by the cooler unit and to supply the stored liquid-phase working fluid to the outside;

a housing including a cooler unit housing of the cooler unit and a buffer unit housing of the buffer unit, the cooler unit and the buffer unit being integrally formed to constitute the housing; and an opening and closing unit made of an insulating material disposed between the cooler unit housing and the buffer unit housing, the opening and closing unit having a panel shape corresponding to the buffer unit housing and being configured to move horizontally through the housing in order to selectively open and close the buffer unit, wherein the cooling source flow unit comprises a cooler-side flow unit extending via the cooler unit and a buffer-side flow unit extending via the buffer unit, wherein a cooling source flowing in the cooler-side flow unit performs heat exchange with the working fluid introduced into the cooler unit, a cooling source flowing in the buffer-side flow unit performs heat exchange with the working fluid stored in the buffer unit, and the cooler-side flow unit and the buffer-side flow unit are connected to each other outside the cooler unit, wherein the cooling source flow unit branches into the cooler-side flow unit and the buffer-side flow unit, and wherein the cooling source flowing in the buffer-side flow unit first performs heat exchange with the working fluid stored in the buffer unit and then joins the cooling source flowing in the cooler-side flow unit at a junction located outside the cooler unit housing.

2. The cooling module according to claim 1, wherein the buffer unit includes an upper part disposed below a lower part of the cooler unit, and wherein the lower part of the cooler unit structurally communicates with the upper part of the buffer unit, the structural communication between the cooler unit and the buffer unit enabling the buffer unit to receive the liquid-phase working fluid cooled by the cooler unit.

3. The cooling module according to claim 1, wherein the opening and closing unit selectively opens and closes the buffer unit by moving between an open state and a closed state, and wherein, in the closed state, the panel shape of the opening and closing unit is further configured to insulate the buffer unit from the cooler unit in order to prevent evaporation of the stored liquid-phase working fluid in the buffer unit by the gas-phase working fluid in the cooler unit that is not yet in a cooled state.

4. The cooling module according to claim 1, wherein the cooling source flow unit is configured to pass sequentially through the buffer unit and the cooler unit, and wherein the cooling source performs heat exchange with the working fluid stored in the buffer unit and then performs heat exchange with the working fluid introduced into the cooler unit.

5. The cooling module according to claim 1, wherein the cooling source flow unit is configured such that the cooling source is introduced through one side of the cooler unit and is discharged through the one side of the cooler unit.

6. The cooling module according to claim 5, wherein the cooling source flow unit has a U-shaped configuration including an upper flow unit and a lower flow unit, the upper and lower flow units each having a far end arranged at a midpoint of a path of the cooling source flow unit through the cooler unit, the U-shaped configuration further including a 180-degree bend that is disposed adjacent to another side of the cooler unit opposite to the one side and connects the far ends of the upper and lower flow units, wherein each of the upper and lower flow units extends from the one side of the cooler unit toward the other side of the cooler unit opposite to the one side, and wherein the cooling source that flows in the upper flow unit first performs heat exchange with the working fluid introduced through the working fluid inlet port, and the cooling source that flows in the lower flow unit then performs heat exchange with the working fluid that has performed heat exchange with the cooling source in the upper flow unit.

7. The cooling module according to claim 1, wherein the buffer unit receives a liquid-phase working fluid from the outside.

8. The cooling module according to claim 1, further comprising an auxiliary cooler unit having a refrigerant flow path, a portion of the refrigerant flow path located in each of the buffer unit and the cooler unit.

9. The cooling module according to claim 1, wherein the buffer unit has an aspect ratio greater than 1.

10. The cooling module according to claim 1, wherein the joining of the cooling source flowing in the buffer-side flow unit and the cooling source flowing in the cooler-side flow unit does not occur inside the cooler unit, and wherein the cooling source flowing in the buffer-side flow unit joins the cooling source flowing in the cooler-side flow unit at an inlet of the cooler unit.

11. The cooling module according to claim 1, wherein the joining of the cooling source flowing in the buffer-side flow unit and the cooling source flowing in the cooler-side flow unit does not occur inside the cooler unit, and wherein the cooling source flowing in the buffer-side flow unit joins the cooling source flowing in the cooler-side flow unit at an outlet of the cooler unit.

12. The cooling module according to claim 1, wherein the cooler unit includes an inlet communicating with the cooler-side flow unit and an outlet communicating with the cooler-side flow unit, wherein the buffer unit includes an inlet communicating with the buffer-side flow unit and an outlet communicating with the buffer-side flow unit, wherein the inlet of the buffer unit communicates with the branch of the cooling source flow unit, and wherein the outlet of the buffer unit communicates with the cooler-side flow unit outside the cooler unit, the outlet of the buffer unit communicating with the cooler-side flow unit at one of a first communication point occurring at the outlet of the cooler unit and a second communication point occurring between the branch of the cooling source flow unit and the inlet of the cooler unit.

13. A power generation system comprising:

a cooling module comprising a cooling source flow unit in which a cooling source supplied from an outside flows, a cooler unit configured to enable a gas-phase working fluid introduced through a working fluid inlet port to undergo a phase change into a liquid-phase working fluid by performing heat exchange with the cooling source flowing in the cooling source flow unit, a buffer unit provided under the cooler unit and configured to receive and store the liquid-phase working fluid cooled by the cooler unit and to supply the stored liquid-phase working fluid to the outside;

a housing including a cooler unit housing of the cooler unit and a buffer unit housing of the buffer unit, the cooler unit and the buffer unit being integrally formed to constitute the housing; and an opening and closing unit made of an insulating material disposed between the cooler unit housing and the buffer unit housing, the opening and closing unit having a panel shape corresponding to the buffer unit housing and being configured to move horizontally through the housing in order to selectively open and close the buffer unit; and a fluid pump for receiving and pumping the liquid-phase working fluid stored in the buffer unit of the cooling module, wherein the cooling source flow unit comprises a cooler-side flow unit extending via the cooler unit and a buffer-side flow unit extending via the buffer unit, wherein a cooling source flowing in the cooler-side flow unit performs heat exchange with the working fluid introduced into the cooler unit, a cooling source flowing in the buffer-side flow unit performs heat exchange with the working fluid stored in the buffer unit, and the cooler-side flow unit and the buffer-side flow unit are connected to each other outside the cooler unit, wherein the cooling source flow unit branches into the cooler-side flow unit and the buffer-side flow unit, and wherein the cooling source flowing in the buffer-side flow unit first performs heat exchange with the working fluid stored in the buffer unit and then joins the cooling source flowing in the cooler-side flow unit at a junction located outside the cooler unit housing.

14. A working fluid supply method using a cooling module comprising a housing including a cooler unit housing and a buffer unit housing, the cooler unit housing and the buffer unit housing being integrally formed to constitute the housing of the cooling module, the working fluid supply method comprising:

supplying a cooling source to a cooling source flow unit in which the cooling source flows, the cooling source flow unit comprising a cooler-side flow unit extending via a cooler unit housed in the cooler unit housing and a buffer-side flow unit extending via a buffer unit housed in the buffer unit housing, the cooler-side flow unit and the buffer-side flow unit connected to each other outside the cooler unit;

cooling a gas-phase working fluid into a liquid-phase working fluid by performing heat exchange between the gas-phase working fluid and the cooling source flowing through the cooler-side flow unit;

storing the cooled liquid-phase working fluid in the buffer unit;

performing a heat exchange process in the buffer unit that includes exchanging heat between a cooling source flowing through the buffer-side flow unit and the working fluid stored in the buffer unit;

transporting the liquid-phase working fluid stored in the buffer unit to a fluid pump; and pumping the liquid-phase working fluid through the fluid pump, wherein the supercritical fluid supply method further comprises:

branching the cooling source flow unit into the cooler-side flow unit and the buffer-side flow unit to perform the heat exchange process in the buffer unit;

joining the cooling source exiting the buffer-side flow unit with the cooling source entering the cooler-side flow unit, the joining occurring at a junction located outside the cooler unit housing; and selectively opening and closing the buffer unit by moving a movable panel that has a shape corresponding to the buffer unit housing and is disposed between the cooler unit housing and the buffer unit housing, the movable panel moving horizontally through the housing between an open state and a closed state to insulate the buffer unit from the cooler unit in the closed state.

15. The working fluid supply method according to claim 14, further comprising:

cooling a gas-phase working fluid contained in the working fluid stored in the buffer unit, which has not been cooled, into a liquid-phase working fluid through a refrigerant flow path, a portion of which is located in the buffer unit, wherein the cooled gas-phase working fluid is stored the buffer unit.

16. The working fluid supply method according to claim 14, further comprising:

replenishing the buffer unit with a liquid-phase working fluid when a level of the working fluid in the buffer unit drops below a predetermined level.

* * * * *